US011697911B2

(12) United States Patent
Hoffman

(10) Patent No.: US 11,697,911 B2
(45) **Date of Patent: *Jul. 11, 2023**

(54) V-SHAPED SNOWPLOW BLADE HAVING TRIP EDGES

(71) Applicant: Venture Products, Inc., Orrville, OH (US)

(72) Inventor: Michael S. Hoffman, Greenwich, OH (US)

(73) Assignee: VENTURE PRODUCTS, INC., Orrville, OH (US)

( * ) Notice: Subject to any disclaimer, the term of this patent is extended or adjusted under 35 U.S.C. 154(b) by 377 days.

This patent is subject to a terminal disclaimer.

(21) Appl. No.: 17/012,307

(22) Filed: Sep. 4, 2020

(65) Prior Publication Data

US 2022/0074153 A1 Mar. 10, 2022

(51) Int. Cl.
*E01H 5/06* (2006.01)

(52) U.S. Cl.
CPC ..... *E01H 5/062* (2013.01); *E01H 5/066* (2013.01)

(58) Field of Classification Search
CPC ..... E01H 5/065; E01H 5/063; E01H 5/062
See application file for complete search history.

(56) References Cited

U.S. PATENT DOCUMENTS

| | | | |
|---|---|---|---|
| 3,650,054 | A | 3/1972 | Hanson |
| 3,772,803 | A | 11/1973 | Cote |
| 3,998,342 | A | 12/1976 | Myers |
| 4,074,448 | A | 2/1978 | Niemela |
| 4,597,202 | A | 7/1986 | Weeks |
| 4,907,358 | A | 3/1990 | Moore |
| 5,025,577 | A | 6/1991 | Verseef |
| 5,109,618 | A | 5/1992 | Grubler et al. |
| 5,437,113 | A | 8/1995 | Jones |
| 6,125,559 | A | 10/2000 | Mullenhour |
| 7,437,839 | B2 | 10/2008 | Christy et al. |
| 7,743,536 | B2 | 6/2010 | Evans et al. |
| 9,051,700 | B2 | 6/2015 | Summers et al. |
| 10,865,534 | B2 | 12/2020 | Martin et al. |
| 2006/0000122 | A1 | 1/2006 | Micozzi |
| 2006/0042128 | A1 | 3/2006 | Schultz et al. |
| 2007/0271828 | A1 | 11/2007 | Mishra et al. |
| 2009/0282706 | A1 | 11/2009 | Barker et al. |

(Continued)

FOREIGN PATENT DOCUMENTS

WO 2020087179 A1 5/2020

*Primary Examiner* — Jamie L McGowan
(74) *Attorney, Agent, or Firm* — Sand, Sebolt & Wernow Co., LPA

(57) ABSTRACT

A V-blade for a snowplow, a snowplow incorporating the V-blade and a method of use thereof. The blade includes left and right wings engaged with one another. A trip edge is provided on each wing and includes a lower section of moldboard, a cutting edge, and a snow shield. Each trip edge engages an upper section of the associated moldboard via a biasing assembly. The biasing assembly biases the trip edge into alignment with the moldboard's upper section and also biases the trip edge towards a central vertical axis. When the V-blade strikes an obstacle on the surface during snow removal, the trip edges individually pivot about a horizontal axis extending along a shaft of the associated biasing assembly. The trip edges subsequently translate linearly along the horizontal axis and away from the vertical axis.

17 Claims, 14 Drawing Sheets

(56) References Cited

U.S. PATENT DOCUMENTS

| | | | | |
|---|---|---|---|---|
| 2013/0232827 | A1 | 9/2013 | Summers et al. | |
| 2014/0237865 | A1* | 8/2014 | Jones | E01H 5/066 16/374 |
| 2016/0076285 | A1 | 3/2016 | Jones et al. | |
| 2018/0127935 | A1* | 5/2018 | Paonessa | E01H 5/065 |
| 2019/0017237 | A1* | 1/2019 | Michel | E01H 5/062 |
| 2019/0136473 | A1* | 5/2019 | Desrochers | E01H 5/066 |
| 2019/0136474 | A1 | 5/2019 | Martin et al. | |
| 2019/0203436 | A1* | 7/2019 | Martin | E01H 5/066 |
| 2019/0234034 | A1 | 8/2019 | Kovalick | |
| 2019/0323204 | A1* | 10/2019 | Vigneault | E01H 1/105 |
| 2022/0243411 | A1* | 8/2022 | Vigneault | E01H 5/062 |

* cited by examiner

V-SHAPED SNOWPLOW BLADE HAVING TRIP EDGES

TECHNICAL FIELD

This disclosure is directed to equipment for snow removal. In particular the disclosure relates to a snowplow blade. Specifically, the disclosure is directed to a V-shaped snowplow blade with a left wing and a right wing that each have a trip edge thereon. The trip edge comprises a part of the moldboard of the blade along with a cutting edge (or wear board) that is secured thereto. The trip edge has a first degree of freedom and a second degree of freedom, namely, rotation about a horizontal axis and linear motion along the horizontal axis. When the blade strikes an obstacle on a surface while clearing snow therefrom, one or both trip edges will pivot about the associated horizontal axis and relative to an upper section of the moldboard. When both trip edges trip and pivot and begin to contact each other, the trip edges will translate linearly along the associated horizontal axis and momentarily move away from each other.

BACKGROUND

Background Information

Snowplows are used to remove accumulated snow from surfaces such as roadways and sidewalks. The plows typically comprise some type of vehicle, such as a truck or utility vehicle, and a snowplow blade that is mounted to the vehicle by a hitch assembly. Snowblade blades can be straight blades, V-shaped blades that present an apex as the leading edge of the blade, and adjustable blades that can be manipulated to form a V-shape, an inverted V-shape, or be configured as a straight blade. The hitch assembly can be utilized to manipulate the blade by raising or lowering the same. In some instances, the hitch assembly can also be used to angle the snowplow blade relative to a vertical axis of the vehicle to more effectively remove snow from a surface.

Regardless of the configuration of the snowplow blade, these blades typically include a concavely-curved surface for gathering snow from a surface over which the vehicle and blade travel and redirecting the snow away from the surface. This curved surface is known as the moldboard and is typically fabricated from a material such as steel and or even stainless steel. The moldboard is therefore a relatively expensive piece of equipment. In order to preserve the integrity of the moldboard and increase the component's life, a separate cutting edge (also known as a wear board, wear blade, or scraper) is removably engaged the bottom edge of the moldboard. The cutting edge is the component of the snowplow blade that will travel along the surface of the roadway or sidewalk and scrape snow off the same, directing that snow upwardly toward the moldboard. The cutting edge may be fabricated from less-expensive materials than the moldboard. In some embodiments, the cutting edge may be fabricated from a less expensive steel or from materials such as urethane. Over time, the cutting edge will be worn down by its constant contact with the roadways or sidewalks from which the snowplow blade removes snow. If the cutting edge is worn down to too great an extent, the moldboard may start to contact the ground and become damaged. Consequently, when it is determined the cutting edge has reached this point, the cutting edge may be removed from the moldboard and be replaced with a new cutting edge.

One of the issues that occurs when clearing snow is that the roadways and sidewalks can include solid obstacles such as manhole covers, uneven sidewalk slabs, curbs, and so on. If the snowplow is moving along the roadway or sidewalk with the snowplow blade in a lowered position removing snow from the surface, when the blade strikes the obstacle, the impact of that strike can damage the blade or the hitch assembly. The impact force can also be transferred back into the vehicle making the ride jarring and uncomfortable for the snowplow operator.

In order to aid in addressing this problem, some snowplow blades have been configured to trip when they strike solid obstacles. This "tripping" has taken two different forms in the prior art. In some instances, the entire snowplow blade (moldboard plus cutting edge) will lift vertically and/or pivot slightly about a horizontal axis as a unit when an obstacle is struck. In some instances, the horizontal axis about which the entire blade pivots is an axis located on the hitch assembly. Examples of the entire moldboard tripping include U.S. Pat. No. 4,074,448 (Niemela) and U.S. Pat. No. 4,907,344 (Moore).

In other instances, only the cutting edge of the snowplow blade will trip when an obstacle is struck by the cutting edge. In some instances the cutting edge will lift vertically to a certain degree relative to the moldboard. In other instances, the cutting edge will pivot relative to the moldboard about a horizontal axis. Examples of snowplows where only the cutting edge trips include U.S. Pat. No. 3,772,803 (Cote), U.S. Pat. No. 5,025,577 (Verseef), and U.S. Pat. No. 5,437,113 (Jones).

In some instances, the snowplow blades can include both moldboard tripping and cutting edge (i.e., wear blade) tripping. An example of this configuration is found in U.S. Pat. No. 9,051,500 (Summers et al).

V-shaped snowplow blades present a particular problem when they strike obstacles in the roadway or on the sidewalk. V-shaped snowplow blades includes a left side blade or "left wing" and a right side blade or "right wing". The left wing and right wing may be fixedly secured to one another so that the blade is permanently V-shaped. In these instances, the blades are frequently mounted that the entire moldboard (i.e., the entire blade) trips when the blade encounters an obstacle. In other instances, the central region between the left wing and right wing and below a shaft to which the wings are attached will be free of a cutting edge. A trippable cutting edge will be engaged with the left wing and another trippable cutting edge will be engaged with the right wing. The two cutting edges will be sufficiently distanced from one another so as not to strike one another when they trip. If the two cutting edges are physically too close to one another then, when they trip, they might strike one another and become damaged.

In other instances, the V-shaped blade is adjustable in configuration as indicated earlier herein. U.S. Pat. No. 9,051,500 (Summers et al) referred to earlier herein discloses a multi-position V-shaped snowplow blade that can be adjusted to various different configurations. The left wing and right wing of these adjustable V-shaped blades will connect to a central hinge and will be rotatable about a vertical axis that extends along the central hinge. The region between the bottom regions of the left wing and right wing is generally triangular in shape and a separate component, a snow catcher or snow shield, is engaged with each wing. The shield(s) close off the triangular shaped gap between the bottom regions of the left wing and right wing and will contact the surface so that as the blade travels over the surface snow is cleared from even below the central hinge.

When the blade is in an inverted V-shape with the apex as the leading part of the blade, this arrangement does not present too many issues if the wear blade on only one or the other of the left wing and right wing trips. However, if the snowplow blade impacts an obstacle that causes the cutting edges or wear blades on both the left and right wings to trip substantially simultaneously, then the snow shields on the two wings may contact or interfere with one another when the cutting edges both pivot. This interference may prevent the cutting edges from tripping properly and/or can result in damage to the cutting edges or even to the moldboard.

SUMMARY

The present disclosure is directed to a V-shaped snowplow blade (V-blade) that has a cutting edge which, together with a lower part of the moldboard, will trip when the blade strikes an obstacle on the roadway or on the sidewalk. In one embodiment, the V-blade is an adjustable snowplow blade that may be manipulated into a number of different configurations. As such, the V-blade may also be referred to as a multi-position snowplow blade. The cutting edge and lower part of the moldboard of the trip edges of both wings of the V-blade will automatically pivot and translate laterally when tripped, i.e., the trip edges will automatically pivot and subsequently move linearly away from each other. In particular, the cutting edge and lower part of the moldboard will move laterally along a horizontal axis in a direction moving away from the central hinge to which the left wing and right wing are secured. If both the left wing and right wing strike an obstacle and trip substantially simultaneously, the disclosed configuration of the snowplow blade will substantially prevent interference between the pivoting trip edges by moving laterally away from the central shaft with which the wings are engaged. This linear motion of the trip edges away from each other will reduce the likelihood of damage to the cutting edges, the snow shields, and the moldboards of the two wings.

A V-blade for a snowplow, a snowplow incorporating the V-blade and a method of use thereof are disclosed herein. The blade includes left and right wings engaged with a central shaft. A trip edge is provided on each wing and includes a lower section of moldboard, a cutting edge, and a snow shield. The trip edges engages an upper section of the moldboard via a biasing assembly. The biasing assembly biases the trip edge into alignment with the upper section and biases the trip edge towards the central shaft. When the trip edge strikes an obstacle on the surface being cleared of snow, the trip edge pivots relative to the upper section about a horizontal axis extending along a shaft of the biasing assembly and subsequently translates along the horizontal axis away from the central shaft if and when the trip edges on the left and right wings trip. The trip edge returns to its original position under spring force.

In one aspect, an exemplary embodiment of the present disclosure may provide a V-blade for a snowplow comprising a left wing; a right wing; and a trip edge provided on each of the left wing and the right wing; wherein each trip edge has a first degree of freedom and a second degree of freedom; and wherein each trip edge is adapted to be tripped by encountering an obstacle on a surface being cleared of snow by the V-blade.

In one embodiment, the first degree of freedom may be rotational motion about a horizontal axis and the second degree of freedom may be linear motion along the horizontal axis. In one embodiment, each of the left wing and the right wing may include a moldboard with which the trip edge is operatively engaged; and wherein the trip edge may be biased into a non-tripped position relative to the moldboard. In one embodiment the V-blade may further comprise a biasing assembly that biases the trip edge into the non-tripped position. The biasing assembly may be a spring assembly. In one embodiment the spring assembly may be a torsion spring assembly. In one embodiment, the trip includes a cam that transforms the rotational motion to the linear motion. In one embodiment the V-blade may further comprise a snow shield provided on a first side of the trip edge; and wherein the snow shield may act as the cam. In one embodiment the V-blade may be a multi-position blade and the left wing and right wing may be operably engaged with a central hinge.

In another aspect, an exemplary embodiment of the present disclosure may provide in combination a utility vehicle; a blade adapted to clear snow from a surface; and a hitch assembly that detachably engages the blade to the utility vehicle, wherein the hitch assembly is operable to manipulate the blade relative to the surface being cleared of snow; wherein the blade includes a moldboard and a trip edge provided on each of a left wing and a right wing of the blade, wherein each trip edge has a first degree of freedom and a second degree of freedom relative to the associated moldboard, and wherein each trip edge is adapted to trip by encountering an obstacle on the surface being cleared of snow.

In one embodiment, the blade may be a multi-position blade. In one embodiment, the trip edge may move through the first degree of freedom and the second degree of freedom when the blade is in a V-configuration and the trip edge is tripped. In one embodiment the first degree of freedom may be rotation about a horizontal axis; and the second degree of freedom may be linear motion along the horizontal axis.

In another aspect, an exemplary embodiment of the present disclosure may provide a method of preventing damage to a V-blade of a snowplow comprising operatively engaging a left wing and a right wing of the V-blade with a central shaft; providing a trip edge on a moldboard of each of the left wing and the right wing of the V-blade; biasing the trip edge into alignment with the moldboard; biasing the trip edge toward the central shaft; pivoting the trip edge relative to the moldboard about a horizontal axis when the trip edge impacts an obstacle on a surface from which the V-blade is clearing snow; and translating the trip edge linearly in a first direction along the horizontal axis when the trip edge pivots.

In one embodiment, the translating of the trip edge in the first direction may include moving the trip edge away from the central shaft when the trip edge on the left wing begins to contact the trip edge on the right wing. In one embodiment, the method may further comprise moving beyond the obstacle; translating the trip edge linearly along the horizontal axis in an opposite second direction relative to the moldboard; and pivoting the trip edge about the horizontal axis and back into alignment with the moldboard. In one embodiment, the method may further comprise providing a cam along a first side of the trip edge and at least partially beneath the central shaft; transforming the pivotal motion of the trip edge to the linear motion of the trip edge utilizing the cam.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
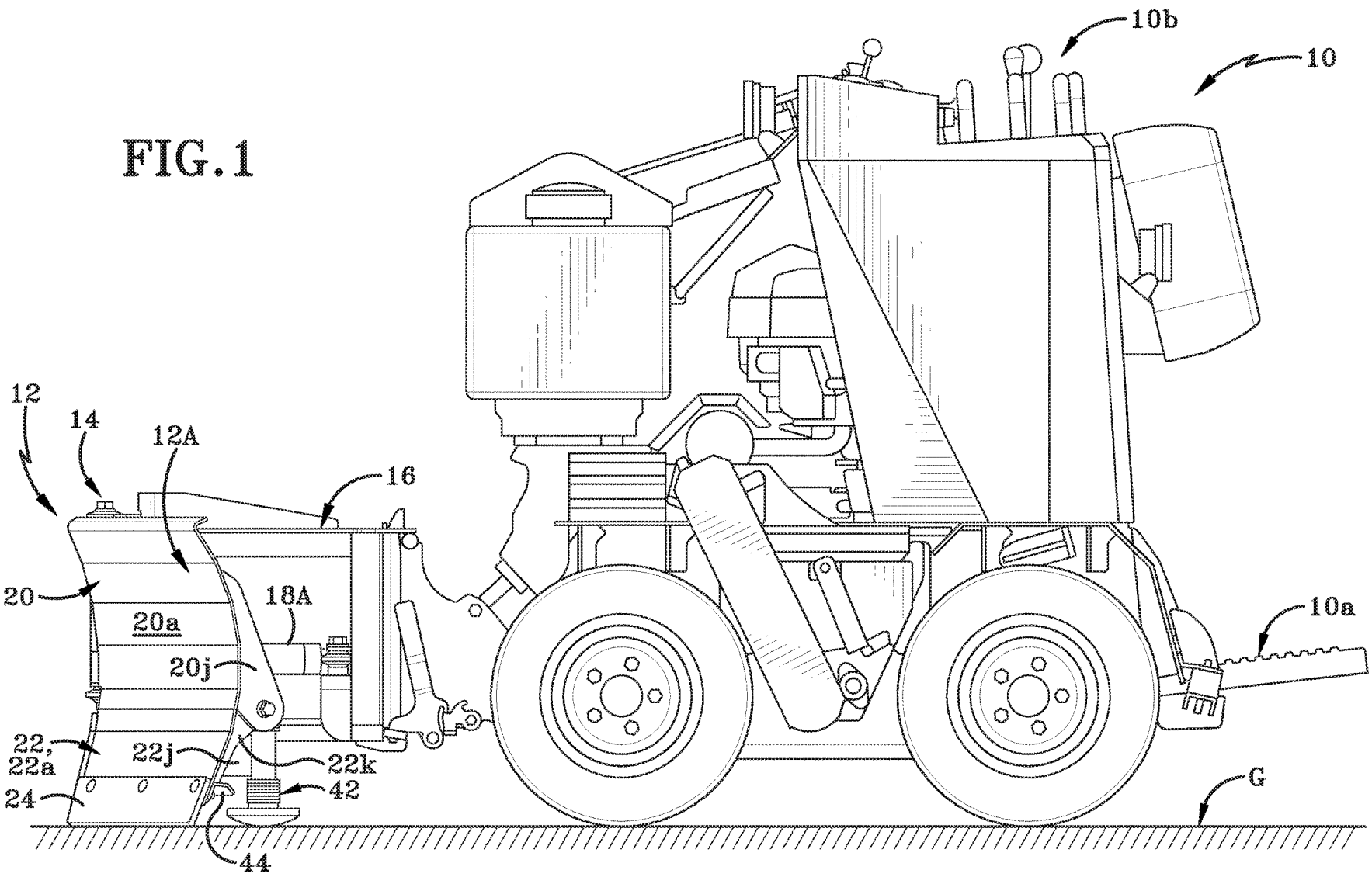
FIG. 1 is a left side elevation view of a snowplow comprising a utility vehicle upon which is mounted a V-shaped blade in accordance with the present disclosure.

FIG. 1 shows a utility vehicle 10 upon which is mounted a snowplow blade in accordance with the present disclosure, generally indicated at 12. As illustrated, the vehicle 10 includes a platform 10*a* upon which an operator will stand. Vehicle 10 also includes a control panel 10*b* that the operator uses to control the vehicle 10 and blade 12. Utility vehicle 10 is illustrated as a relatively small vehicle that may be used by a landscaping company or an individual to maintain driveways, sidewalks, and smaller surfaces that need to be cleared of snow but might require the vehicle to move in tight spaces. It will be understood that utility vehicle 10 is exemplary only and may be any vehicle that is capable of being used in winter conditions. It will be understood that if the vehicle 10 is a larger truck, the snowplow blade 12 may be fabricated to be of a size suitable for use therewith and that in such instances, the vehicle 10 and blade 12 may be utilized to clear snow from roadways, parking lots, and other larger surfaces.

Figure 2:
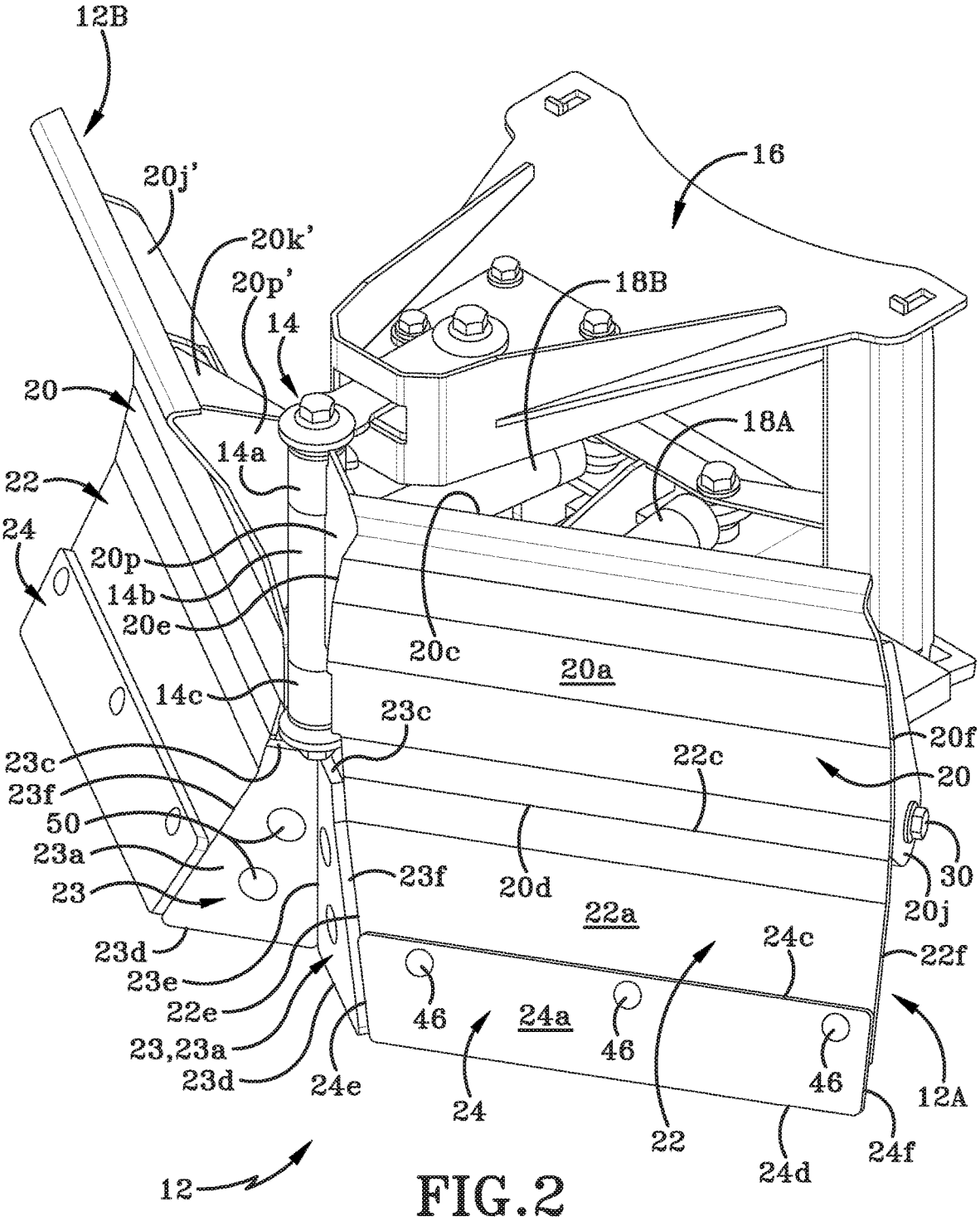
FIG. 2 is a front, top, left, isometric perspective view of the blade of FIG. 1 in accordance with the present disclosure shown on its own.

FIG. 2 shows snowplow blade 12 on its own. Blade 12 is a V-blade that, as illustrated and described herein, may be reconfigured to present different snow-clearing profiles as the conditions require. The V-blade may therefore be referred to as an adjustable snowplow blade or a multi-position snowplow blade. The adjustability of blade 12 will be discussed later herein.

Blade 12 comprises a left wing 12A and a right wing 12B that are each operably engaged with a central hinge 14. Each of the left wing 12A and right wing 12A may be individually pivoted about a vertical axis "Y" (FIGS. 3 and 4) that extends along a shaft (not shown) of central hinge 14. Vertical axis "Y" comprises a central vertical axis about which left and right wings 12A and 12B may be pivoted to move blade 12 into different configurations.

A hitch assembly 16 is operably engaged with left wing 12A, right wing 12B, and central hinge 14. Hitch assembly 16 is utilized to secure blade 12 to utility vehicle 10 and is operable to raise, lower, and reconfigure blade 12. Hitch assembly 16 as illustrated is exemplary only and it should be understood that any other suitable type of hitch assembly may be utilized to secure blade 12 to utility vehicle 10 and to permit operation of blade 12. Hitch assembly 16 will therefore not be described in any detail herein. One suitable hitch assembly for operatively engaging the blade 12 to utility vehicle 10 is disclosed in a copending patent application assigned to the present Assignee, Venture Products, Inc. That copending patent application is U.S. patent application Ser. No. 16/150,873, filed Oct. 3, 2018, entitled "Unique Attachment Assembly and Method of Use". The entire disclosure of this copending application is incorporated herein by reference.

Figure 3:
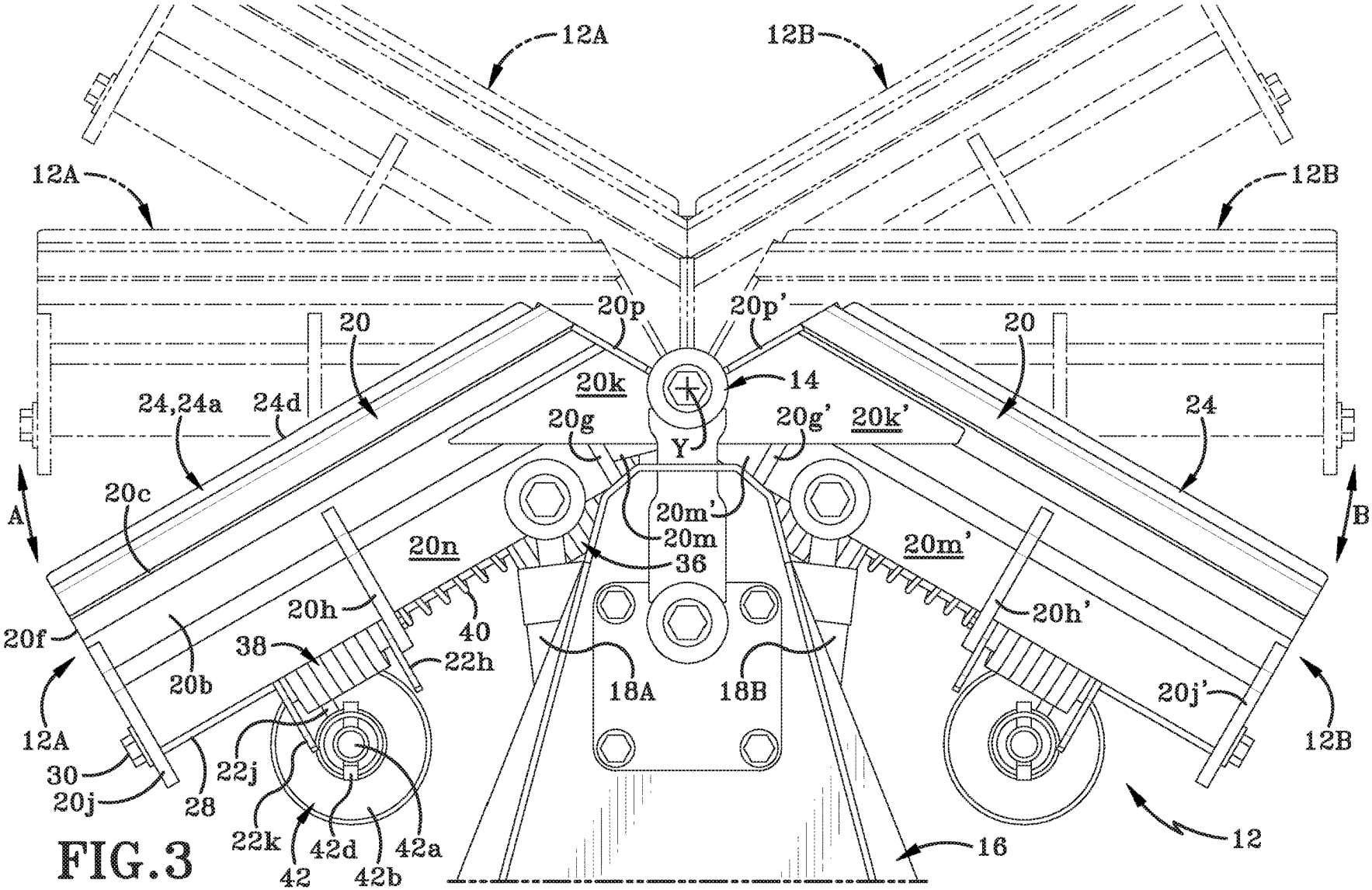
FIG. 3 is a top plan view of the blade of FIG. 2 illustrating the adjustability of the blade.

As best seen in FIG. 3, a first cylinder 18A of hitch assembly 16 operably engages left wing 12A to hitch assembly 16 and a second cylinder 18B operably engages right wing 12B to hitch assembly 16. First and second cylinders 18A, 18B may be hydraulic cylinders that are operatively linked to the hydraulic system of vehicle 10 or are engaged with a separate hydraulic system provided on vehicle 10. Alternatively, first and second cylinders 18A, 18B may be pneumatic cylinders that are operatively linked to a pneumatic system of vehicle 10 or are engaged with a separate pneumatic system provided on vehicle 10. Alternatively, first and second cylinders 18A, 18B may be electrically actuated.

First and second cylinders 18A, 18B are separately operable from vehicle 10 to pivot the associated left wing 12A and right wing 12B about the vertical axis "Y" (FIGS. 3 and 4) extending along central hinge 14. First cylinder 18A is operable to pivot left wing 12A about vertical axis "Y" as indicated by the arrows "A" in FIG. 3. Similarly, second cylinder 18B is operable to pivot right wing 12B about vertical axis "Y" as indicated by the arrows "B" in FIG. 3. By selectively pivoting left wing 12A and right wing 12B, snowplow blade 12 can be configured to be generally an inverted V-shape when viewed from above from vehicle 10 as shown in solid lines in FIG. 3. Snowplow blade 12 can also be configured so that the left wing 12A and right wing 12B are aligned in a same plane. In this instance, the blade 12 assumes the same shape as a straight snowplow blade, as is shown in phantom in FIG. 3. Left wing 12A and right wing 12B may further be reconfigured to generally assume a V-shape when viewed from above from the vehicle 10, as further shown in phantom in FIG. 3. Still further, each of the left wing 12A and right wing 12B is able to be positioned anywhere between the generally inverted V-shape and the V-shape. Consequently, the snowplow blade 12 is selectively manipulated to assume a variety of different configurations to best enable the device to remove snow from different surfaces.

Left wing 12A and right wing 12B are substantially identical in structure and function and are engaged with central hinge 14 as mirror images of one another. The following description is directly primarily to left wing 12A but it will be understood that the description applies equally to right wing 12B. Differences between the left wing 12A and right wing 12B will be pointed out.

Referring mainly to FIGS. 2 to 7 and 10A, left wing 12A of blade 12 comprises a moldboard which includes an upper section 20 and a lower section 22, a shield 23 (also referred to herein as a snow shield 23), and a cutting edge 24. The cutting edge 24 may also be referred to herein as a wear board or wear blade. Shield 23 and cutting edge 24 are operatively engaged with lower section 22 of the moldboard. Lower section 22, shield 23, and cutting edge 24, together, form a trip edge that is able to pivot about a horizontal axis "X" (FIGS. 5 and 10) relative to upper section 20 of moldboard. The first, second, and third parts of the trip edge, i.e. lower section 22, 23, and 24, are configured to move in unison with one another and relative to the upper section 20 of the moldboard. The trip edge 22, 23, 24 is also able to translate, i.e., move, laterally and horizontally along the horizontal axis "X" will be described later herein.

Figure 8:
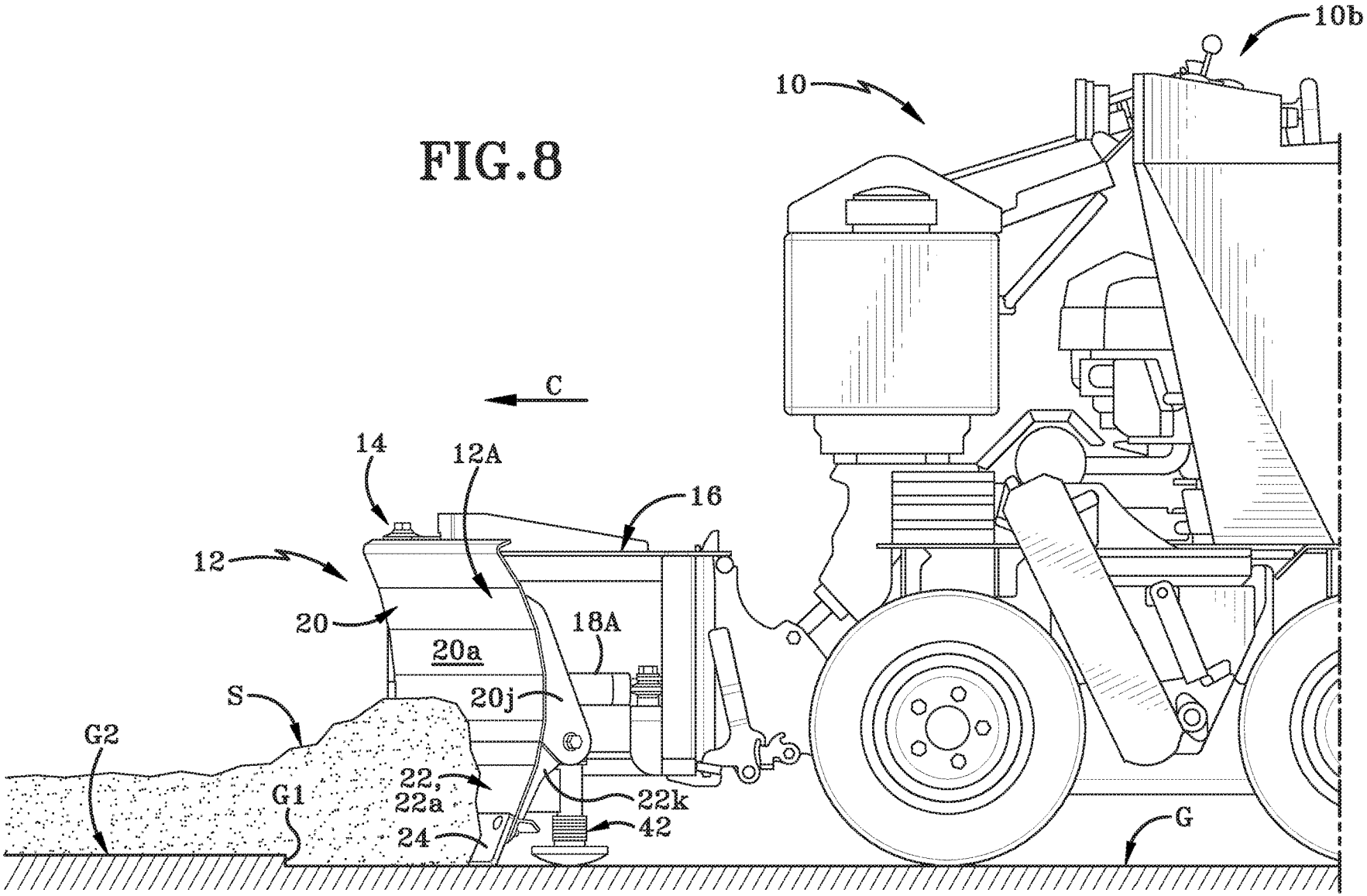
FIG. 8 is a partial left side elevation view of the snowplow in use and showing the blade traveling along a surface removing snow, and further showing a solid obstacle a distance in front of the blade.

The upper section 20 and lower section 22 are fabricated from the same material. Suitable materials are steel or stainless steel. It is not contemplated that the lower section 22 will contact the surface "G" (FIG. 8) over which the V-blade 12 is traveling. Instead, the components of left wing 12A that will contact the surface "G" or be in close proximity thereto are cutting edge 24 and snow shield 23. Typically, the cutting edge 24 is fabricated from a different material than upper section 20 and lower section 22. In one embodiment, the cutting edge 24 is fabricated from a less expensive and less durable material than upper section 20 and lower section 22, such as urethane or a less expensive steel. Since snow shield 23 also contacts the surface "G", snow shield 23 may also tend to wear away over time through contact with surface "G". For this reason, snow shield 23 may be fabricated from the same material or a similar material to cutting edge 24. In other embodiments, the snow shield 23 may be fabricated from the same material as upper and lower sections 20, 22 of the moldboard.

As shown in FIGS. 2 to 5, upper section 20 of the moldboard is a generally concavely-curved component having a front surface 20*a*, a rear surface 20*b* (FIG. 4), a top edge 20*c*, a bottom edge 20*d* (FIG. 10A), a first side 20*e* (FIG. 5), and a second side 20*f*. A first plate 20*g* (FIG. 4), a second plate 20*h*, and a third plate 20*g* extend rearwardly from the rear surface 20*b*. First plate 20*g*, second plate 20*h*, and third plate 20*j* are vertically oriented and extend outwardly from rear surface 20*b*, generally at right angles thereto. First plate 20*g* is located a distance inwardly from first side 20*e*, second plate 20*h* is located generally midway between first side 20*e* and second side 20*f*, and third plate 20*j* is located adjacent second side 20*f*. First, second, and third plates 20*g*, 20*h*, 20*j* are laterally spaced a distance apart from one another in such a way that the plates are generally equidistantly spaced across rear surface 20*b* of upper section. Plates 20*g*, 20*h*, 20*j* originate a distance downwardly from top edge 20*c* and a leading portion of each plate 20*g*, 20*h*, 20*j* terminates proximate bottom edge 20*d*. A trailing portion of each plate 20*g*, 20*h*, 20*j* extends downwardly for a distance below bottom edge 20*d* of upper section 20, as can best be seen in FIG. 10A. With this arrangement, the trailing portion of each plate 20*g*, 20*h*, 20*j* overlaps part of the lower section 22 of the moldboard of left wing 12A but is not secured thereto.

Upper section 20 of the moldboard also includes a first plate 20*k* (FIG. 4), a second plate 20*m*, and a third plate 20*n*, which are horizontally-oriented and parallel to one another. The plates 20*k*, 20*m*, and 20*n* extend outwardly from rear surface 20*b* of upper section 20. First plate 20*k* and second plate 20*m* extend horizontally between vertical first plate 20*g* and central hinge 14. First plate 20*k* is located a distance vertically above second plate 20*m*. Central hinge 14 includes a vertical shaft (not shown) around which an upper sleeve 14*a*, a middle sleeve 14*b*, and a lower sleeve 14*c* are received. (The vertical axis "Y" about which left wing 12A and right wing 12B pivot extends along this shaft of central hinge 14.) Upper sleeve 14*a* and lower sleeve 14*c* are welded to right wing 12B and middle sleeve 14*b* is welded to left wing 12A. In particular, first plate 20*k* and second plate 20*m* are welded to middle sleeve 14*b* of central hinge 14. Third plate 20*n* is located vertically a distance below second plate 20*m*. Third plate 20*n* extends from first plate 20*g*, through a slot in second plate 20*h*, and to third plate 20*j*. Third plate 20*n* may be received in slots in first and third plates 20*g*, 20*j*. Third plate 20*n* preferably is welded to first, second, and third plates 20*g*, 20*h*, and 20*j*.

It should be noted that second wing 12B has three vertically oriented plates 20*g*', 20*h*', and 20*j*'. Second and third plates 20*h* and 20*j* of left wing 12A are substantially identical in structure to second and third plates 20*h*' and 20*j*' of right wing 12B. First plates 20*g* and 20*g*' are slightly differently configured to second and third plates 20*g*, 20*g*', 20*h*, and 20*h*'. In particular, first plate 20*g*' is longer than first plate 20*g* but other than that, is substantially identical in structure to first plate 20*g*. Second wing 12B includes two horizontally oriented plates 20*k*' and 20*m*' that extend between first plate 20*g*' and central hinge 14. In particular, first plate 20*k*' is welded to upper sleeve 14*a* of central hinge 14. Second plate 20*m*' is welded to lower sleeve 14*c* of central hinge 14. Second plate 20*m*' additionally extends between first plate 20*g*', second plate 20*h*' and third plate 20*j*'. Second plate 20*m*' may pass through aligned slots defined in the first, second, and third plates 20*g*', 20*h*' and 20*j*' and be welded to these plates. The arrangement of the engagement of left wing 12A, right wing 12B, and central hinge 14 enables left and right wings 12A, 12B to be individually pivoted about central hinge 14 and relative to one another when actuated by cylinders 18A and 18B, respectively.

It will be understood that in other embodiments the arrangement of the vertically-oriented first, second, and third plates 20*g*, 20*h*, 20*j* and the horizontally-oriented first, second, and third plates 20*k*, 20*m*, 20*n* of left wing 12A may, instead, be provided on right wing 12B; and the vertically-oriented first, second, and third plates 20*g*', 20*h*', 20*j* and horizontally-oriented first and second plates 20*k*', 20*m*' of right wing 12B may, instead, be provided on left wing 12A.

FIGS. 2 and 3 show that a first side plate 20*p* is welded to first side 20*e* of left wing 12A proximate top edge 20*c* thereof. Similarly, a first side plate 20*p*' is welded to first side 20*e* of right wing 12A proximate the top edge thereof. The first side plates 20*p* and 20*p*' flank central hinge 14 and are positioned forwardly of the first plates 20*k*, 20*k*'. First side plates 20*p*, 20*p*' aid in preventing snow that rides up the moldboard from becoming wedged between central hinge 14 and the left and right wings 12A, 12B.

Figure 4:
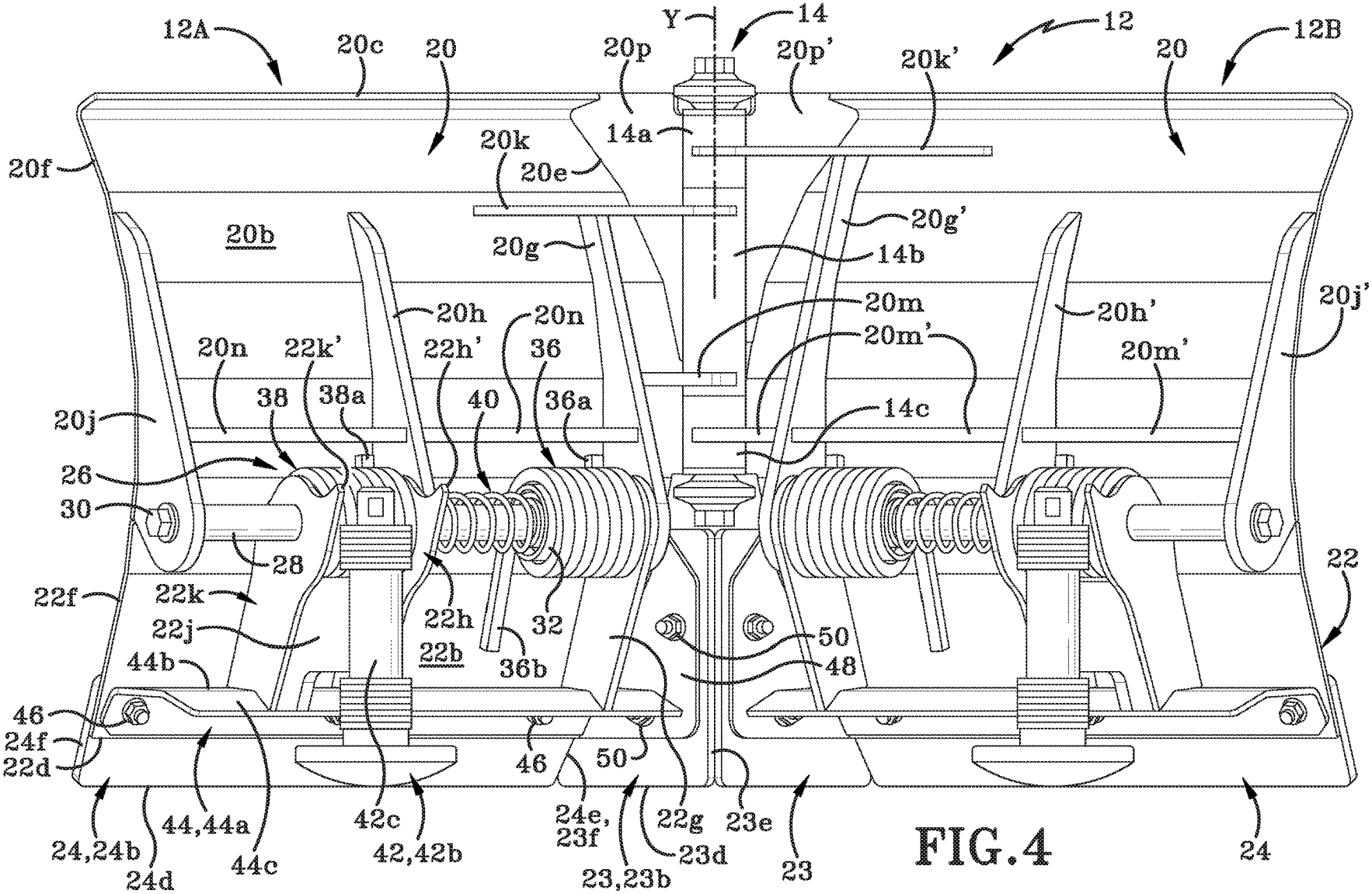
FIG. 4 is a rear elevation view of the blade with the hitch assembly omitted for clarity of illustration.
Figure 5:
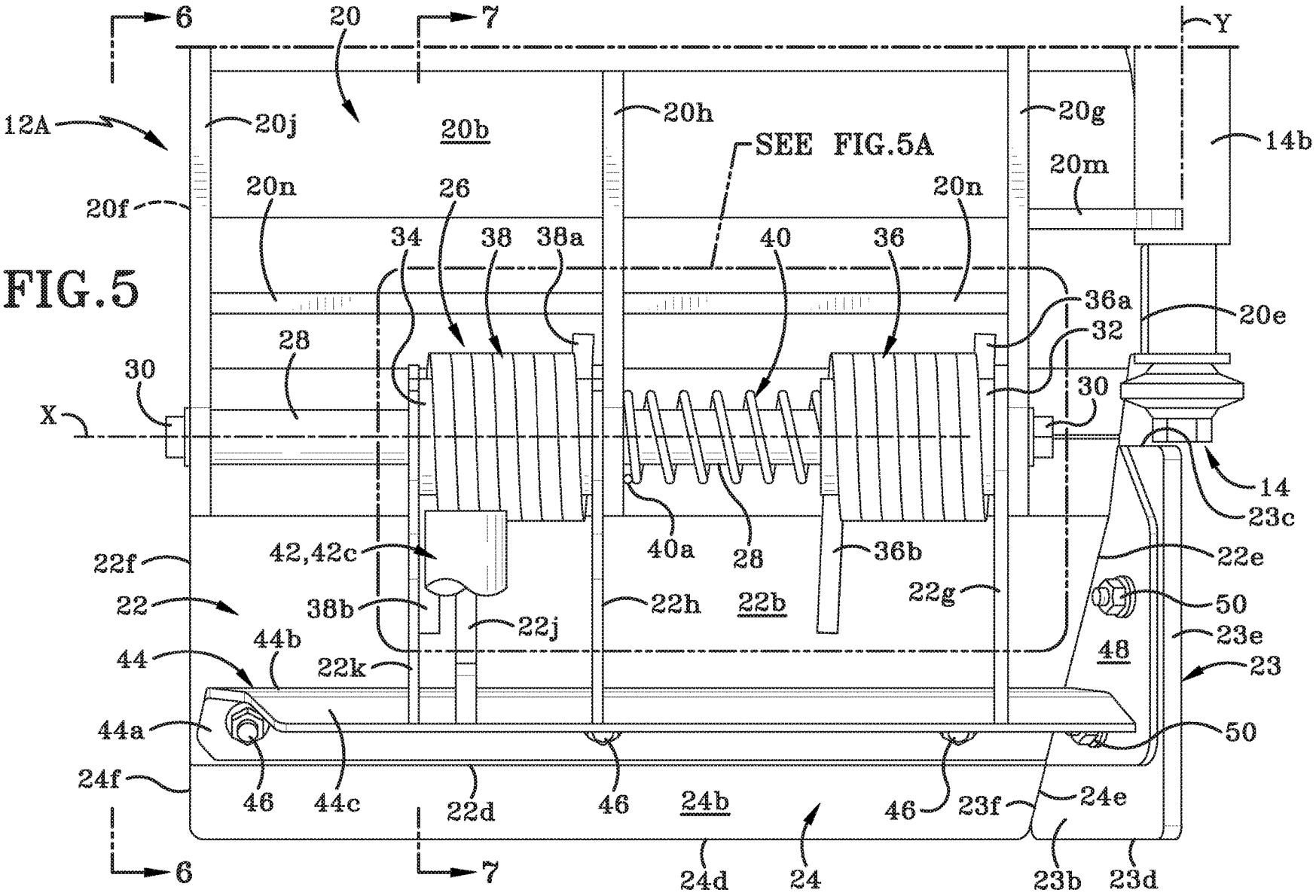
FIG. 5 is a partial rear elevation view of the left wing of the blade with the skid shoe partially removed for clarity of illustration.
Figure 6:
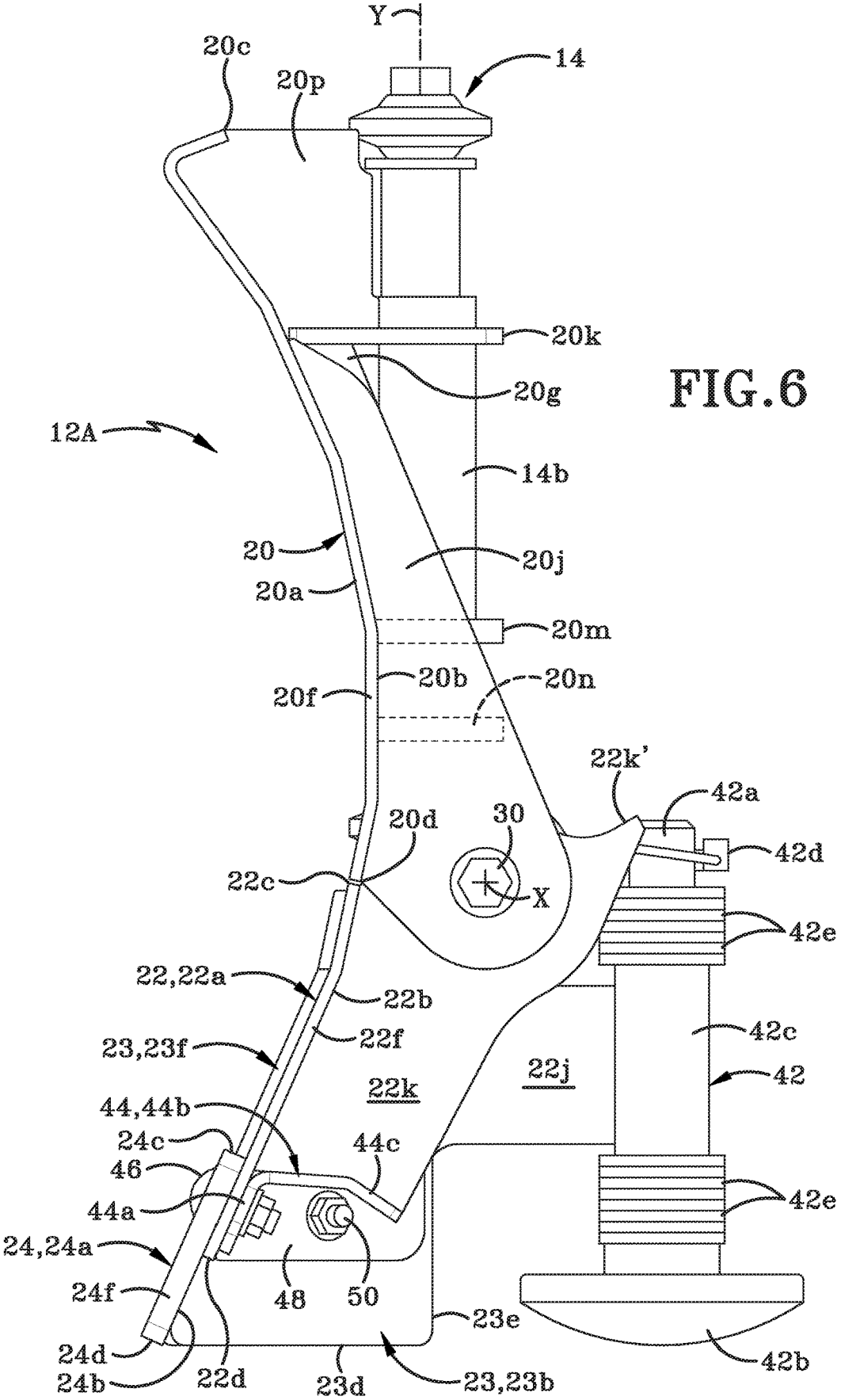
FIG. 6 is a left side elevation view of the left wing of the blade taken along line 6-6 of FIG. 5.

Referring still to FIGS. 2 to 7, 10A and 10B, lower section 22 is a generally rectangular member that is substantially concavely-curved when viewed from the left side, as in FIG. 6. When V-blade 12 is in an untripped (i.e., non-tripped) condition, such as is illustrated in FIG. 6, the concave curvature of lower section 22 of the moldboard generally follows the radius of curvature of the upper section 20 thereof. Lower section 22 has a front surface 22*a*, a rear surface 22*b* (FIG. 7), a top edge 22*c*, a bottom edge 22*d* (FIG. 10A), a first side 22*e* (FIG. 10B), and a second side 22*f*.

Referring to FIG. 4, a first bracket 22*g*, a second bracket 22*h*, a third bracket 22*j*, and a fourth bracket 22*k* extend rearwardly from the rear surface 22*b* of the lower section 22. First, second, third, and fourth brackets 22*g*, 22*h*, 22*k* are vertically oriented and are laterally spaced from one another. Each of the first bracket 22*g*, second bracket 22*h*, and fourth bracket 22*k* extends generally from proximate top edge 22*c* of lower section 22 to proximate bottom edge 22*d* thereof. First bracket 22*g* is located inwardly of but proximate to first plate 20*g* on upper section 20 and such that a lower region of first plate 20*g* overlaps an upper region of first bracket 22*g*. In particular, the upper region of first bracket 22*g* abuts the lower region of first plate 20*g*. Second and fourth brackets 22*h*, 22*k* are located between second plate 20*h* and third plate 20*j*. In particular, a lower region of second and fourth plates 20*h*, 20*k* overlaps an upper region of second and third brackets 22*h*, 22*j*. The upper region of second bracket 22*h* abuts the lower region of second plate 20*h*. Fourth bracket 20*j* is laterally spaced from second bracket 20*h* and is located generally midway between the second plate 20*h* and third plate 20*j*. Third bracket 22*j* is located between second bracket 22*h* and fourth bracket 22*k*. In the illustrated embodiment, third bracket 22*j* is located closer to fourth bracket 22*k* than to second bracket 22*h*. Third bracket 22*j* is of a smaller height than are any of the first, second, and fourth brackets 22*g*, 22*h*, 22*k*. In particular a top edge of third bracket 22*k* does not extend above top edge 22*c* of lower section 22. This can be seen in FIG. 7.

Second bracket 22*h* and fourth bracket 22*k* are substantially identical in structure and function. First bracket 22*g* and third bracket 22*j* are dissimilar in shape and in function to second and fourth brackets 22*h* and 22*k*. Second bracket 22*h* includes a stop 22*h*' (FIGS. 4 and 7) along its top edge. Similarly, fourth bracket 22*k* includes a stop 22*k*' (FIGS. 4 and 6) along its top edge. The purposes of the stops 22*k*' and 22*k*' will be discussed later herein.

Each of first wing 12A and second wing 12B of blade 12 is provided with a biasing assembly 26 that urges the lower section 22 of the associated wing into alignment with the upper section 22 thereof. Stated otherwise, the biasing assembly urges the trip edge into alignment with the upper section 22 of the moldboard. In the illustrated embodiment, the biasing assembly 26 is a spring assembly, particularly a torsion spring assembly. It will be understood that in other embodiments, other types of biasing assembly or biasing mechanisms may be utilized instead of the illustrated torsion spring assembly. Any suitable mechanisms may be utilized that perform this same biasing function as the illustrated torsion spring assembly.

The illustrated torsion spring assembly 26 includes a guide rod 28, fasteners 30, a first sleeve 32 (FIG. 5A), a second sleeve 34, and one or more torsion springs. In particular, the torsion spring assembly 26 as illustrated herein includes a first torsion spring 36 and a second torsion spring 38. The torsion spring assembly 26 further includes a coil spring 40.

An aperture is defined in the lower region of each of the first, second, and third plates 20*g*, 20*h*, 20*j* of upper section 20. A hole is defined in each of the upper regions of the first, second, and fourth brackets 22*g*, 22*k*. The apertures and holes are laterally aligned with one another and the guide rod 28 of the torsion spring assembly 26 extends therethrough. The fasteners 30 secure guide rod 28 to first and third plates 20*g*, 20*j*. First sleeve 32 is located proximate first bracket 22*g* and includes a first end 32*a* and a second end 32*b*. Second end 32*b* is located proximate first bracket 22*g* and in some embodiments is welded to first bracket 22*g*. An annular channel 32*c* is defined in first sleeve 32 and the channel 32*c* extends inwardly from an opening in first end 32 and terminates a distance from second end 32*b*. The first sleeve 32 also defines a bore 32*d* through which guide rod 28 is received. It will be understood that in other embodiments where first sleeve 32 is welded to first bracket 22*g*, the channel 32*c* may extend all the way to second end 32*b* of first sleeve 32. First torsion spring 36 circumscribes first sleeve 32 in such a way that a first end 36*a* of first torsion spring 36 contacts the rear surface 20*b* of upper section 20 of the moldboard. A second end 36*b* of first torsion spring 36 contacts the rear surface 22*b* of the lower section 22 of the moldboard.

Figure 5A:
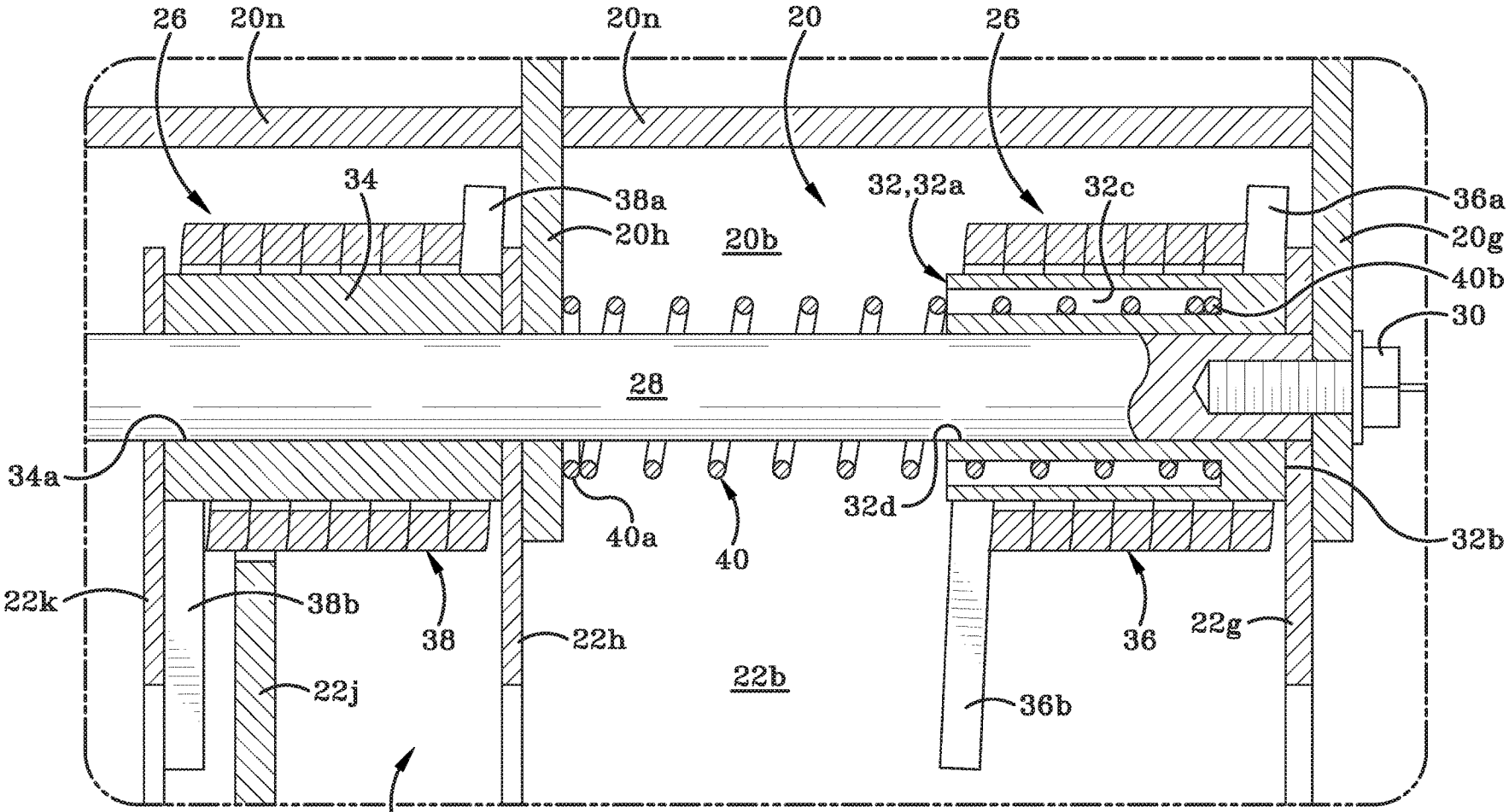
FIG. 5A is an enlarged vertical cross-section of the highlighted region demarcated by dot-dot-dash lines in FIG. 5.
Figure 7:
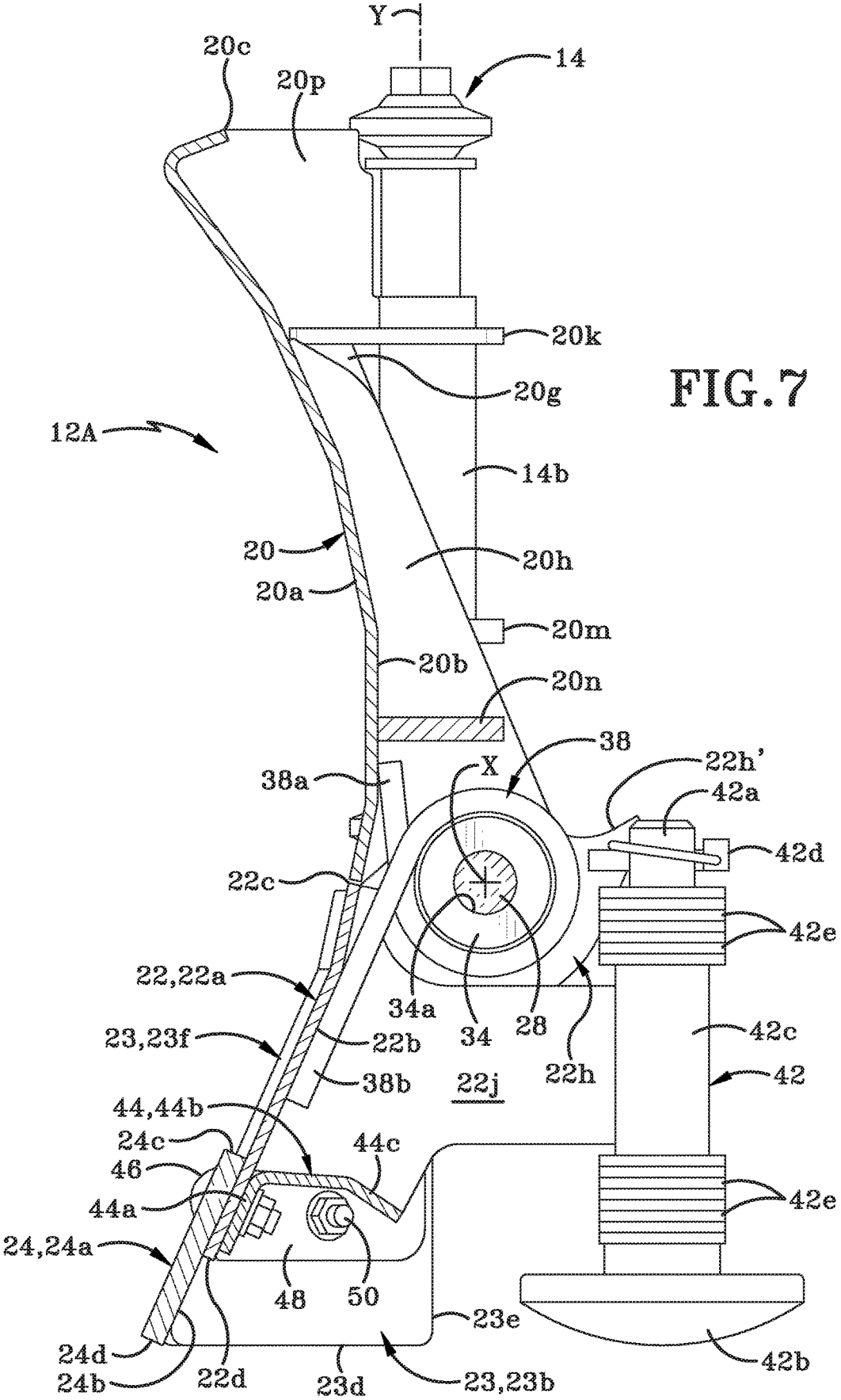
FIG. 7 is a cross-section through the left wing of the blade taken along line 7-7 of FIG. 5.

Similarly, as shown in FIGS. 5A and 7, guide rod 28 is received through the bore 34*a* of second sleeve 34 that is located proximate second plate 20*h*. Second torsion spring 38 is received about second sleeve 34. Second torsion spring 38 has a first end 38*a* that abuts rear surface 20*b* of upper section 20 and a second end 38*b* that abuts the rear surface 22*b* of lower section 22. First and second torsion springs 36, 38 bias lower section 22 and thereby the trip edge forwardly and into alignment with upper section 20. The spring force applied by the torsion spring assembly 26 to keep the trip edge aligned with the upper section 20 of the moldboard is sufficient to ensure that the blade 12 is capable of clearing snow "S" (FIG. 9A) from a surface "G" without the trip edge tripping. The trip edge will only trip when blade 12 encounters an obstacle "G1" of a sufficient size that an impact of the wing 12A or 12B, or the entire blade 12 with the obstacle will overcome the spring force provided by the torsion spring assembly 26.

As shown in FIG. 5A, coil spring 40 circumscribes guide rod 28 and is positioned between first bracket 22*g* and second plate 20*h*. Coil spring 40 has a first end 40*a* that contacts second plate 20*h* and a second end 40*b* that is received in channel 32*c*. Coil spring 40 biases first bracket 22*g* and thereby the entire trip edge towards central hinge 14. The purpose of coil spring 40 will be described later herein.

Referring to FIGS. 1 and 6, left wing 12A includes a skid shoe 42 that aids in keeping cutting edge 24 slightly off the surface "G" to be cleared. Skid shoe 42 is operatively engaged with third bracket 22*j* of lower section 22 and is particularly useful when blade 12 is used to clear snow from gravel driveways or roadways. In particular, skid shoe 42 may be utilized to raise or lower the blade 12 relative to the surface "G". As best seen in FIG. 6, skid shoe 42 includes a central rod 42*a* that has an enlarged curved shoe 42*b* provided at a lower end thereof. Rod 42*a* passes through a central bore of a skid shoe mount 42*c* that is welded to the trailing edge of third bracket 22*j*. Shoe 42*b* is located below the skid shoe mount 42*c* and a section of rod 42*a* extends outwardly beyond an upper end of skid shoe mount 42*c*. Shoe 42*b* is of a greater diameter than the diameter of the central bore of skid shoe mount 42*c*. A through-hole (not shown) is defined in the section of rod 42*a* that extends outwardly beyond the upper end of skid shoe mount 42*c*. A pin 42*d* is removably inserted through the through-hole to prevent rod 42*a* from being withdrawn downwardly through skid shoe mount 42*c*.

A plurality of removable washers 42*e* is received around rod 42*a* in locations above and below skid shoe mount 42*c*. The operator of vehicle 10 is able to set the distance between shoe 42*b* and the lower end of skid shoe mount 42*c* by changing the number of washers 42*e* located between shoe 42*b* and the lower end of skid shoe mount 42*c*. As illustrated in FIG. 6, eight washers 42*e* are located below skid shoe mount 42*c* and seven washers 42*e* are located above skid shoe mount 42*c*. If the operator wishes to raise blade 12 off the ground to a greater extent, he or she will remove pin 42*d* and slide rod 42*a* downwardly and out of skid shoe mount 42*c*. An additional number of washers 42*e* that are illustrated as currently being located above skid shoe mount 42*c* in FIG. 6 will then be placed on top of the washers 42*e* which are currently illustrated as located below skid shoe mount 42*c*. The rod 42*a* is then reinserted through the bore of skid shoe mount 42*c* and pin 42*d* will be reengaged in through-hole. Lowering the blade 12 will involve removing some of the washers 42*e* from below the skid shoe mount 42*c* and placing them above the mount 42*c*. The ground-contacting surface of shoe 42*b* may be coated with a friction-reducing material to allow shoe 42*b* to slide relatively easily over surface "G". Because skid shoe 42 is engaged with third bracket 22*j*, skid shoe 42 will move in unison with lower section 22 of the moldboard. In other words, skid shoe 42 will move in unison with the trip edge on blade 12.

As indicated earlier herein, the trip edge includes a snow shield 23 (FIG. 2) that is a generally truncated triangular shape when viewed from the front. Since the shield 23 of right wing 12B is shown with greater clarity in FIG. 2, the various features of the shield 23 of each of the left and right wings 12A, 12B will be discussed with reference to the right wing 12B shown in that figure and the left wing 12A shown in FIG. 5A. Shield 23 has a front surface 23*a*, a rear surface 23*b* (FIG. 5A), a top edge 23*c*, a bottom edge 23*d*, a first side edge 23*e*, and a second side edge 23*f*. Second side edge 23*f* of shield 23 is positioned adjacent first side edge 22*e* of lower section 22 and angles rearwardly therefrom and inwardly towards vertical axis "Y". In particular, shield 23 is oriented at an obtuse angle relative to lower section 22. The first side edges 23*e* of the two shields 23 are located adjacent one another and generally along vertical axis "Y". This can be seen in FIG. 4. At least a part of each shield 23 is generally aligned with central hinge 14 when the trip edge is in an untripped condition.

Cutting edge 24 of left wing 12A is shown in FIGS. 2, 5. and 7 to include a front surface 24*a*, a rear surface 24*b*, a top edge 24*c*, a bottom edge 24*d*, a first side edge 24*e*, and a second side edge 24*f*. An upper region of cutting edge 24 overlaps a bottom region of lower section 22. As best seen in FIGS. 5 and 7 a base plate 44 is provided proximate a lower region of lower section 22 and an upper region of cutting edge 24. Base plate 44 includes a first leg 44*a* that extends for a distance upwardly along the rear surface 22*b* of lower section 22 from proximate the bottom edge 22*d* thereof. A plurality of fasteners 46 secure first leg 44*a* of base plate 44 to the upper region of cutting edge 24 and a lower region of lower section 22. Base plate 44 further includes a second leg 44*b* that extends outwardly and rearwardly from an upper end of first leg 44*a*. Second leg 44*b* is oriented at an obtuse angle (slightly over 90 degrees) relative to first leg 44*a*. A third leg 44*c* extends outwardly from a rear end of second leg 44*b* and angles rearwardly and downwardly therefrom. Third leg 44*c* is oriented at an acute angle relative to an upper surface of second leg 44*b*. First, second, third, and fourth brackets 22*g*, 22*h*, 22*j*, 22*k* terminate adjacent base plate 44, particularly adjacent second and third legs 44*b*, 44*c* thereof. Base plate 44 extends from proximate first side 22*e* of lower section 22 to proximate second side 22*f* thereof and terminates in a side 44*d*. This arrangement is shown in FIG. 5.

When cutting edge 24 is engaged with lower section 22, the bottom region of cutting edge 24 extends downwardly for a distance below the bottom end 22*d* of lower section 22. As best seen in FIG. 5, a bottom edge 24*d* of cutting edge 24 and the bottom edge 23*d* of shield 23 are substantially coplanar and comprise the regions of blade 12 that may contact the surface "G" when blade 12 is used to clear materials such as snow from the surface "G".

A mounting plate 48 (FIGS. 5 and 10B) is secured to snow shield 23 by fasteners 50. Mounting plate 48 abuts first side edge 22*e* of lower section 22 and is welded to first leg 44*a*, second 44*b*, and third legs 44*c* of base plate 44 along the side 44*d*. Mounting plate 48 strengthens shield 23 and base plate 44 helps to support and strengthen the connection between lower section 22 and cutting edge 24.

Having now described the various components of V-blade 12, an exemplary method of using the blade 12 is now described in particular reference to FIGS. 8 to 11. As indicated earlier herein, blade 12 is mounted to a front end of vehicle 10 by hitch assembly 16. Hitch assembly 16 not only secures blade 12 to vehicle 10 but is also the mechanism through which blade 12 is manipulated in order to clear snow "S" from a surface "G", "G1", and "G2".

An operator stands on platform 10*a* (FIG. 1) of vehicle 10 and operates vehicle 10 and blade 12 through manipulating controls 10*b*. Vehicle 10 is driven forwardly over the surface "G" in the direction indicated by arrow "C" in FIG. 8. Blade 12 is positioned to remove snow "S" from the surface "G". In other words, blade 12 is lowered via actuation of the hitch assembly 16 so that bottom edge 24*d* of cutting edge 24 and bottom edge 23*d* of snow shield 23 of each of the left and right wings 12A, 12B of blade 12 are placed on the surface "G" or just slightly above surface "G". The actual height of bottom edges 23*d*, 24*d* is set utilizing the skid shoes 42, as has been previously described herein. As the vehicle 10 continues to move in the direction "C", snow is captured by the curved blade 12 and is pushed forwardly in front of blade 12 and thereby removed from the surface "G".

FIG. 9A shows blade 12 again but the snow has been removed from the figure for clarity of illustration. Both the bottom 24*d* of cutting edge 24 and the bottom 23*d* of shield 23 are in contact with the surface "G" or in close proximity thereto as blade 12 travels with utility vehicle 10 in the direction "C". Additionally, the shoe 42*b* of skid shoe 42 slides along surface "G". If the operator wishes to lift the bottom edges 24*d*, 23*d* further off the surface "G", he or she will adjust the distance of the blade 12 from the surface by increasing the number of washers 42*e* below skid shoe mount 42*c*. Increasing the number of washers 42*e* will lift the cutting edge 24 and snow shield 23 slightly further off the surface "G" but the shoe 42*b* of the skid shoe 42 will continue to slide over the surface "G". If the operator finds the blade 12 is not adequately clearing snow "S" from surface "G", he or she can remove one or more washers 42*e* from the group of washers 42*e* below the skid shoe mount 42*c*. The removal of one or more washers 42*e* will lower the blade 12, moving it closer to the surface "G" and thereby bring bottom ends 24*d*, 23*d* into better contact with surface "G". Shoe 42*b* of skid shoe 42 will continue to slide across the surface "G" as before.

Figure 9A:
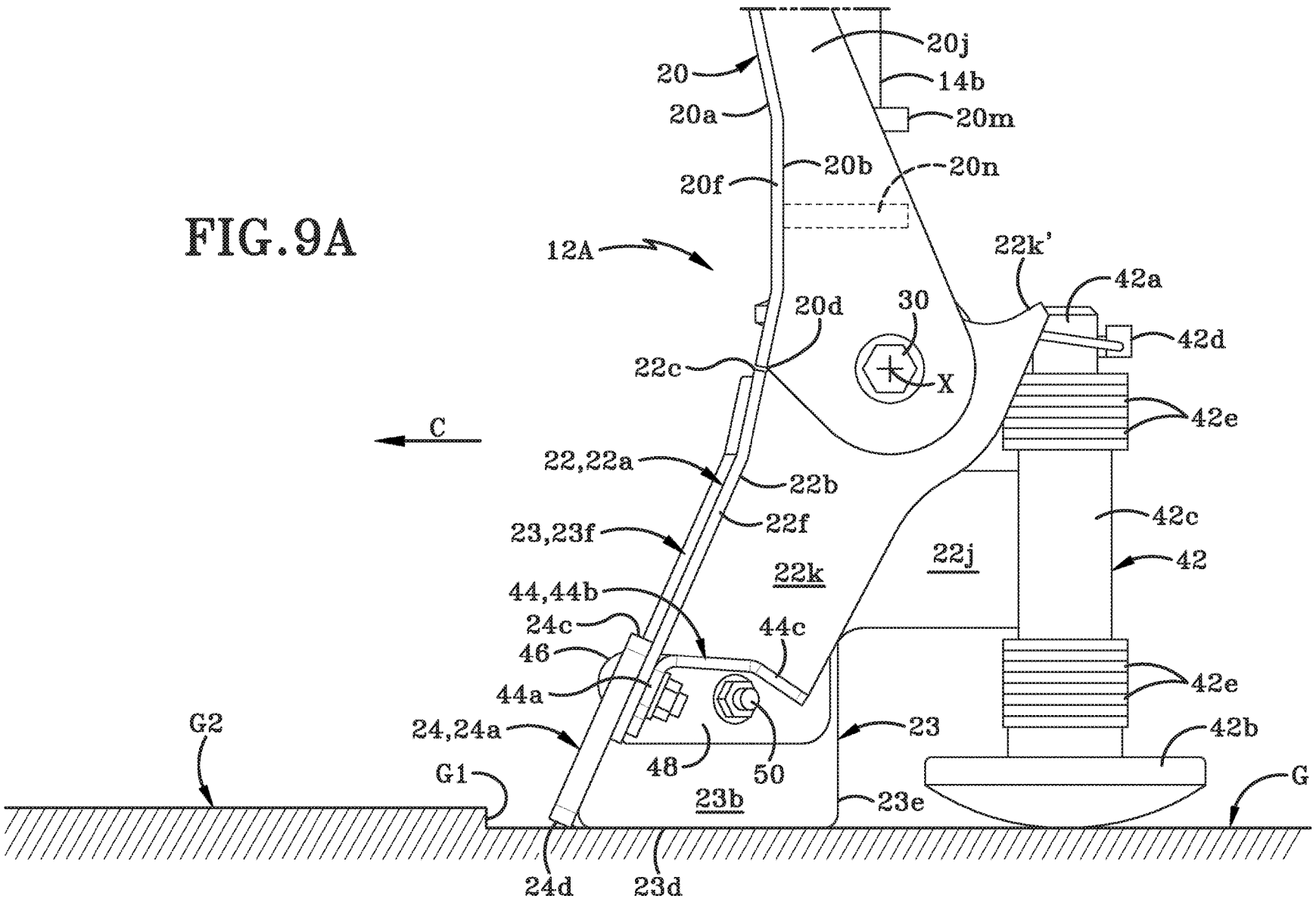
FIG. 9A is a partial, enlarged left side elevation view showing the position of the blade when in contact with the surface and immediately before reaching the obstacle on the surface; and wherein the snow has been removed for clarity of illustration.
Figure 9B:
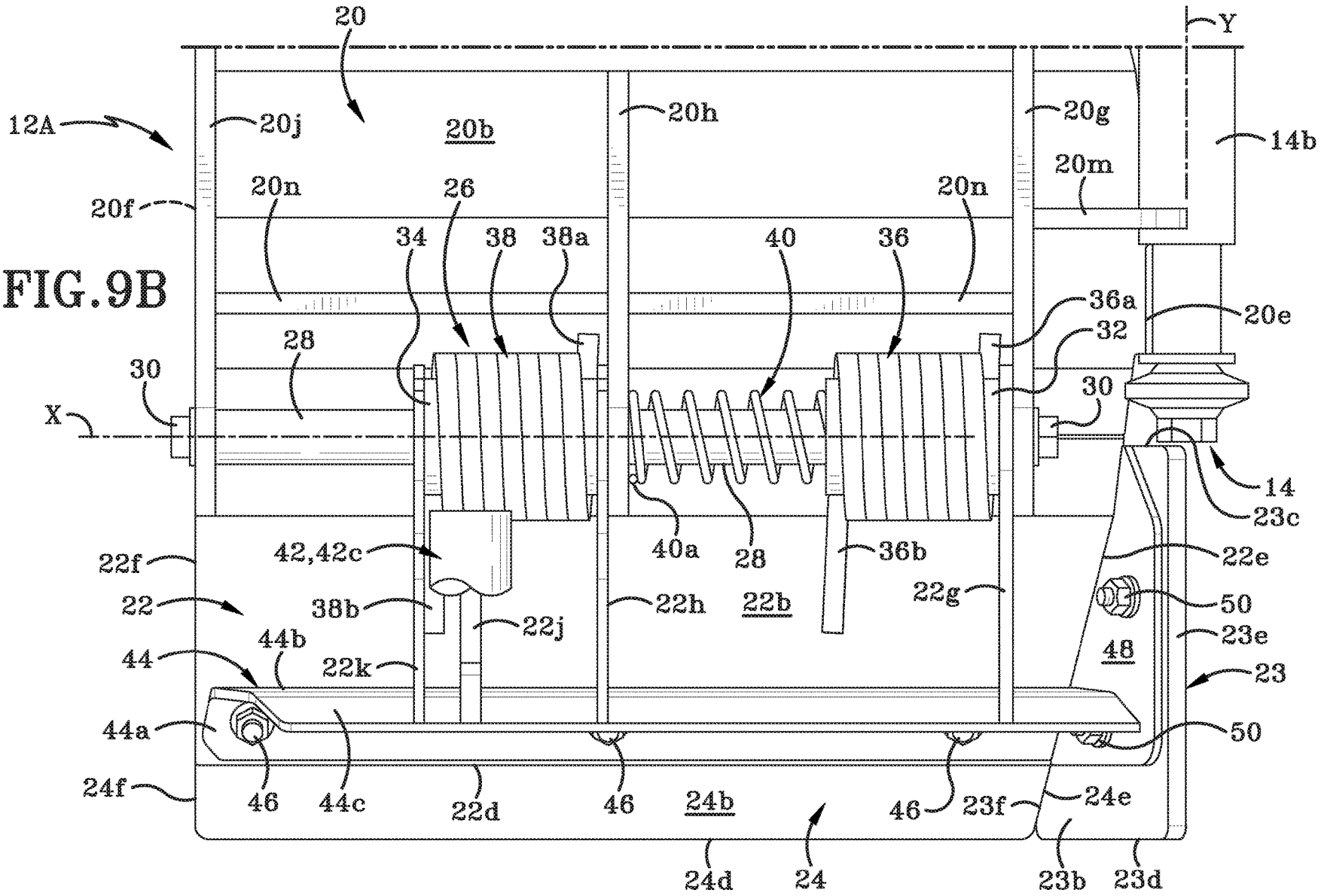
FIG. 9B is a rear elevation view of the blade shown in FIG. 9A with the skid shoe partially removed for clarity of illustration.

FIGS. 9A and 9B show that the surface "G" has an obstacle "G1" at a location a distance in front of the vehicle 10 and the left wing 12A of blade 12 is in a working position where the blade 12 is able to be used for snow removal. In this particular instance, the obstacle "G1" is in the form of raised region of the roadway or sidewalk along which the vehicle 10 is moving. In particular, the elevation of the roadway or sidewalk changes from a first elevation "G" to a second elevation "G2" at the obstacle "G1". It will be understood that the illustrated obstacle "G1" is exemplary of any type of solid obstacle that may lay in the path of the moving blade 12. The obstacle "G1" is sufficiently raised relative to the surface "G" that if the blade 12 strikes it and does not trip, the impact could damage blade 12.

Figure 10A:
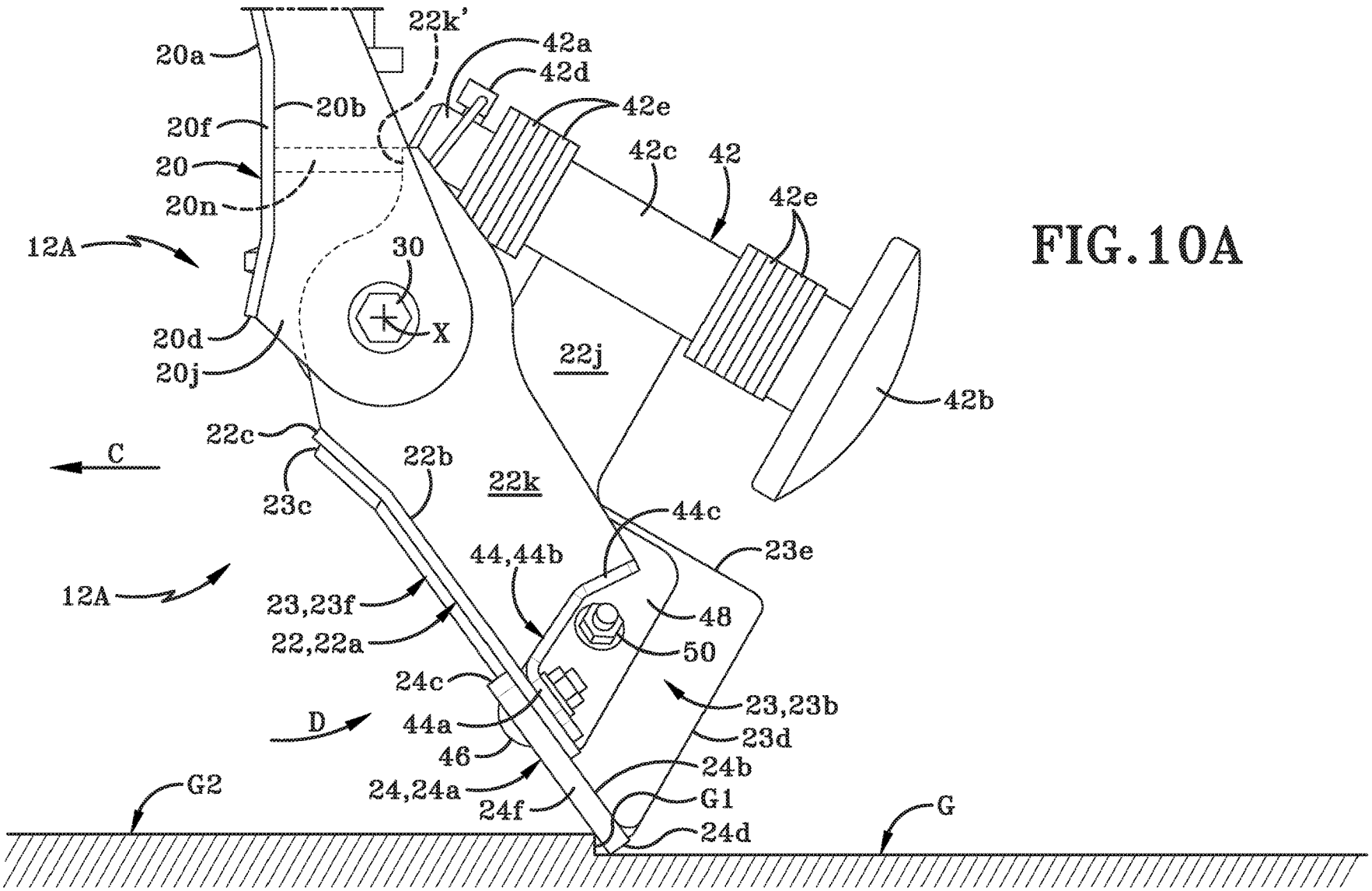
FIG. 10A is a partial left side elevation view showing the lower section of the blade tripping as it encounters the obstacle on the surface.
Figure 10B:
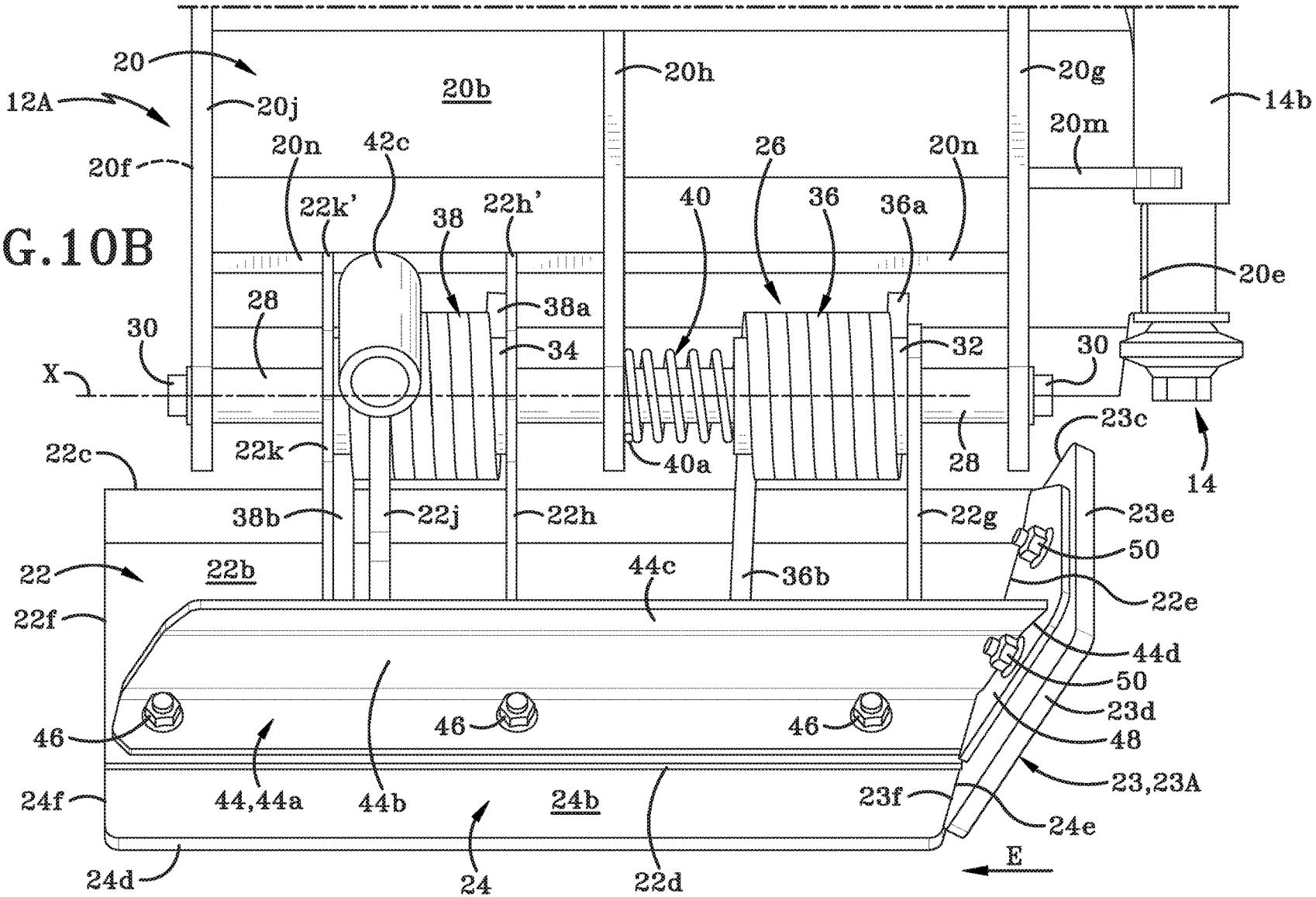
FIG. 10B is a rear elevation view of the blade shown in FIG. 10A with the skid shoe partially removed for clarity of illustration, and showing the lateral translation of the lower section of the blade relative to the upper section thereof.

In accordance with an aspect of the present disclosure and in order to aid in preventing or limiting impact damage to blade 12, the trip edges on the blade (i.e., the components 22, 23, and 24 of one or both wings 12A, 12B) are designed to trip. The term "trip" is used herein to describe the pivotal motion of the lower section 22, snow shield 23, and cutting edge 24, in unison, relative to the upper section 20 of the moldboard and about axis "X". This tripping action occurs when the bottom edge 24*d*, 23*d* encounters the transition "G1". The pivoting tripping action is indicated in FIG. 10A by the arrow "D". As indicated earlier herein, when the trip edge pivots, it does so about the horizontal axis "X" that extends along the guide rod 28 of torsion spring assembly 26. Pivotal motion in the direction of arrow "D" moves the trip edge out of alignment with the upper section 20 of the moldboard and therefore helps the blade skip over the obstacle "G1", avoiding or limiting impact damage thereto. The pivotal motion winds up torsion springs 36 and 38. As best seen in FIGS. 7 and 10B, ultimately, the stop 22*h*', 22*k*', respectively, provided in the top edges of second and fourth brackets 22*h*, 22*k*. When lower section 22 pivots about horizontal axis "X" in the direction "D", second and fourth brackets 22*h*, 22*k* will ultimately come into contact with third plate 20*n* on upper section 20 of the moldboard. In particular, the stops 22*h*', 22*k*' will contact third plate 20*n* and the third plate 20*n* will arrest any further pivotal motion of lower section 22 in the direction "D", thereby limiting the extent of pivotal motion of the trip edge.

The simultaneous pivoting of the trip edge, i.e., lower section 22, snow shield 23, and cutting edge 24, on both wings 12A, 12B also causes a subsequent lateral movement of one or both trip edges along the associated horizontal axis "X". The lateral movement of the left wing 12A is shown in FIG. 10B and is indicated by the arrow "E". This motion "E" is a motion in a first direction moving axially away from central hinge 14. It will be understood that the right wing 12B will move axially away from the central hinge 14 and the left wing 12A in the opposite direction to arrow "E". As left wing 12A translates in the direction of arrow "E", the coil spring 40 becomes compressed as shown in FIG. 10B when first, second, third, and fourth brackets 22*g*, 22*h*, 22*j*, and 22*k* move laterally away from first and second plates 20*g*, 20*h* and towards third plate 20*j*. The decrease in length of coil spring 40 can be seen by comparing FIG. 10B with FIG. 9B. The first arms 36*a*, 38*a* of first and second torsion springs 36, 38 will slide along the rear surface 20*b* of the upper section 20 of the moldboard. In some embodiments, a friction-reducing coating may be applied to at least the lower region of the rear surface 20*b* of upper section 20 to enable this movement to occur smoothly.

The linear motion of trip edge moves shield 23 of left wing 12A laterally further away from central hinge 14 and thereby further away from the shield 23 of the right wing 12B. The two snow shields 23 on the left and right wings 12A, 12B therefore do not interfere with one another as the trip edges of the left and right wings 12A, 12B pivot in the direction "D". As the trip edge of left wing 12A trips and pivots, the skid shoe 42 will be lifted off the surface "S". Because the skid shoe 42 is operatively engaged with third bracket 22*h*, the skid shoe 42 will translate horizontally with the lower section 22.

Figure 11:
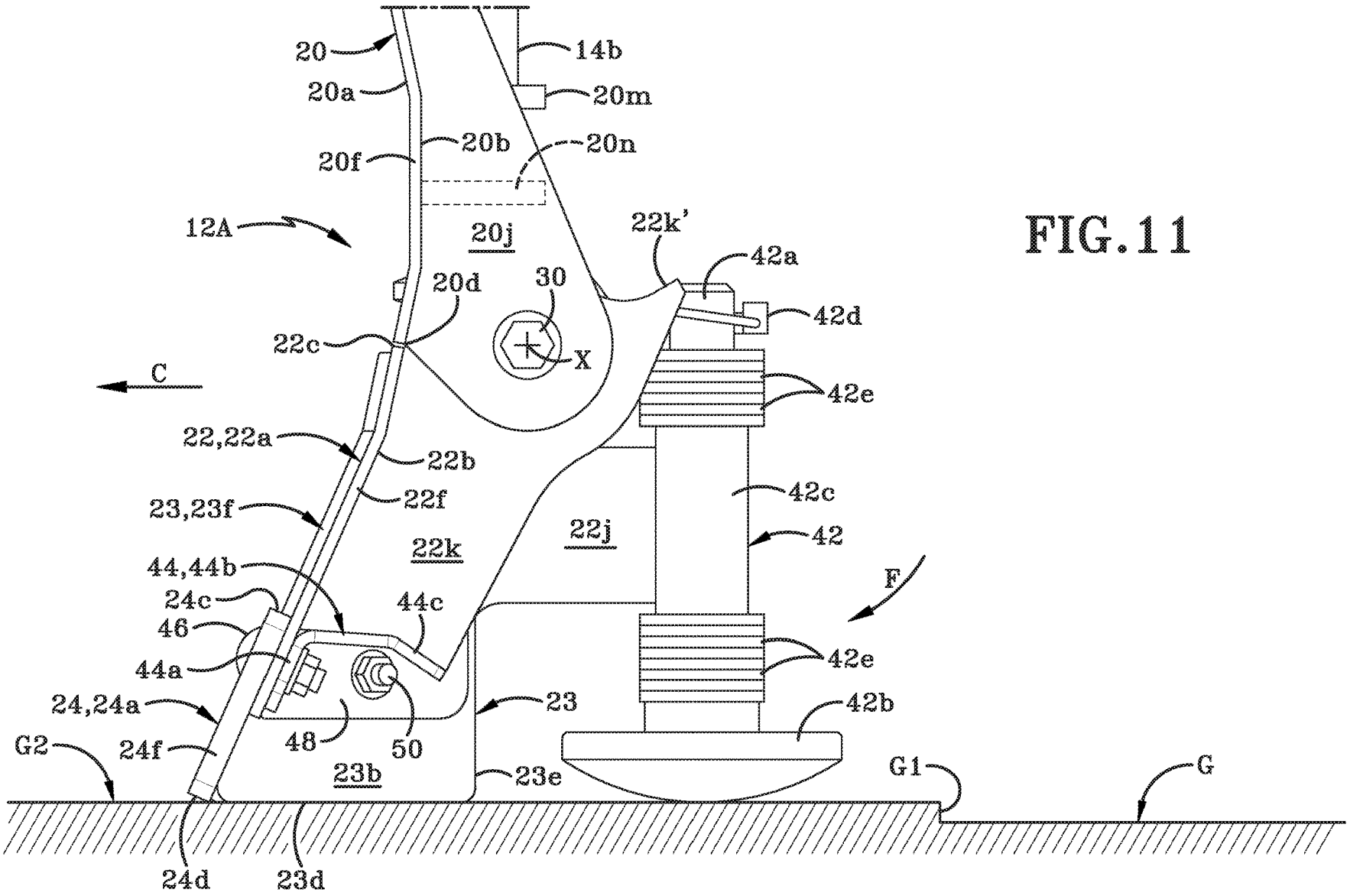
FIG. 11 is a partial left side elevation view of the lower section of the blade returning to its original position.

Utility vehicle 10 will continue moving forwardly in the direction of arrow "C" and as soon as the trip edge has pivoted about the horizontal axis "X" and translated horizontally along the horizontal axis "X", the spring force exerted by the torsion springs 36, 38 and by the coil spring 40 will cause the trip edge to automatically return to its original position. Effectively, the "trip event" is over and the trip edge returns to a position where it effectively aids the upper section 20 of the moldboard to remove snow from the surface "G2". In particular, the first and second torsion springs 36, 38 will return to their at-rest position and as they do so, the second ends 36*b*, 38*b* thereof will push on the rear surface 22*b* of lower section 22 forcing it to pivot in the direction "F" (FIG. 11). Shield 23, and cutting edge 24 will pivot in unison with lower section 22 about the horizontal axis "X". This pivotal motion "F" is in the opposite direction to the pivotal motion "D" caused by the tripping of the blade 12. The pivotal motion in the direction "F" will continue until lower section 22 returns to its at-rest position shown in FIG. 6 where it is generally aligned with upper section 20 of the moldboard.

At substantially the same time that the lower section 22, shield 23, and cutting edge 24 are pivoting in the direction "F" about longitudinal axis "X", the coil spring 40 will begin to return to its at-rest position (i.e., from the position shown in FIG. 10B to the position shown in FIG. 96). As the coil spring 40 expands, it will move the trip edge axially in an opposite direction to arrow "E" (FIG. 9B) and towards the central hinge 14. It will be understood that the lower section 22, shield 23, and cutting edge 24 of right wing 12B will translate in the direction of arrow "E". In other words, the trip edges of the left and right wings 12A, 12B will each move axially back towards the central hinge 14 as those trip edges return to the position they were in before the impact with the obstacle "G1".

The pivoting of the lower section 22, shield 23, and cutting edge 24 in the direction "F" will also bring skid shoe 42 once again back into contact with surface "G". Continued motion of the vehicle 10 in the direction indicated by arrow "C" will allow blade 12 to continue to remove snow "S" from the surface. That surface is now the elevated surface "G2".

As indicated earlier herein, the left wing 12A and right wing 12B are capable of articulating relative to one another about central hinge 14. The operator will utilize the control panel 10*b* on vehicle 10 to manipulate the left and right wings 12A, 12B to the desired orientation relative to one another to effectively remove snow "S" from surface "G" or "G2". In other words, the wings 12A, 12B can form an inverted V-shape, a straight blade shape, or a V-shape or any shape therebetween. In any of these instances, should another trip event occur, the pivoting and translating trip edge will ensure there is little likelihood of damage occurring to the cutting edge 24 and snow shields 23 through inadvertent contact between the two wings 12A, 12B.

A method of using blade 12 in accordance with the present disclosure, as will be summarized hereafter, helps to ensure that the blade 12 will be less likely to be damaged if it impacts an obstacle "G1" while being used to clear snow off a surface "G". The method includes providing a trip edge 22, 23, 24 on a moldboard 20 of each of a left wing 12A and a right wing 12B of the V-blade 12; biasing the trip edge 22, 23, 24 into alignment with the upper section 20 of the moldboard with a torsion spring assembly 26, biasing the left wing 12A and right wing 12B towards a central hinge 14 with the torsion spring assembly 26, impacting an obstacle "G1" on a surface "G" with the trip edge 22, 23, 24; pivoting (in a direction "D"—FIG. 9A) the trip edge 22, 23, 24 relative to the upper section 20 of the moldboard about a horizontal axis "X" when the trip edge impacts the obstacle "G1"; and simultaneously translating the trip edge 22, 23, 24 laterally in a first direction "E" along the horizontal axis "X", and relative to the upper section 20 of the moldboard. The translating of the two trip edges away from each other occurs when the trip edges begin to contact each other as they pivot. The translating of the trip edge 22, 23, 24 in the first direction "E" includes moving the trip edge away from a central shaft 14 with which each of the left wing 12A and right wing 12B are engaged. The pivoting and translating of the trip edge 22, 23, 24 stores potential spring force in the torsion spring assembly 26.

The snowplow 10 will continue to move forwardly in the direction "C" and beyond the obstacle "G1". Substantially immediately after the trip edge 22, 23, 24 has pivoted in the direction "D" and translated horizontally in the first direction "E" along the "X" axis, the trip edge will start to move laterally in an opposite second direction to the arrow "E" under spring force exerted as the coil spring 40 returns to its expanded condition. The trip edge 22, 23, 24 will also substantially simultaneously start to pivot in the direction "F" (FIG. 12) under spring force exerted by the torsion springs 36, 38 as they return to their at-rest condition. The pivoting in the direction "F" and translating in the opposite direction to arrow "E" continues until the trip edge is once again generally in alignment with the upper section 20 of the moldboard and the snow shield 23 is generally vertically aligned with at least part of the central hinge 14.

The method of using blade 12 further includes providing a snow shield 23 along a first side of the trip edge, i.e., the first side 22*e* of lower section 22 of the moldboard and at least partially beneath the central shaft 14. Having the trip edges 22, 23, 24 of the left wing 12A and right wing 12A able to translate away from one another in opposite directions by moving outwardly away from the central shaft 14, helps to avoid interfering contact between the trip edge on the left wing 12A and the trip edge on the right wing 12B. In particular, the ability to translate the trip edges helps to avoid interfering contact between the snow shield 23 provided on the left wing 12A and the snow shield 23 provided on the right wing 12B. The translating of the two trip edges is effectively caused by each trip edge pushing the other trip edge away from it. Snow shields 23 thereby each act as a cam in that the pivotal motion of the trip edge about the horizontal axis "X" is translated into linear motion along the horizontal axis "X" by the interacting snow shields 23 of the left and right wings 12A, 12B.

It will be understood, obviously, that if the obstacle "G1" is only in the path of one of the left wing 12A and right wing 12B, then only the trip edge 22, 23, 24 of that particular wing of the blade 12 will trip. If the obstacle "G1" extends across at least a portion of the roadway or sidewalk surface in front of both of the left wing 12A and right wing 12B, both trip edges 22, 23, 24 will trip, pivoting about the horizontal axis "X" and translating axially and laterally outwardly away from one another in order to avoid contact between the two snow shields 23. These motions aid in preventing damage to the trip edges and particularly to the snow shields 23 provided thereon.

While it has been described that left wing 12A and right wing 12B are engaged with central hinge 14 and are selectively pivotable relative to vertical axis "Y", it will be understood that in other embodiments, the upper sections 20 of the left and right wings 12A, 12B may be fixedly welded to a central shaft or post instead of to sleeves 14*a*, 14*b*, 14*c* of a central hinge 14. In these instances, the left and right wings of the blade 12 remain in a fixed orientation relative to one another and to the central shaft at all times. In these embodiments, the trip edge will be substantially as illustrated and described with respect to V-blade 12 and will function in the same way as described herein.

While it has been shown and described herein that the trip edge comprises the lower section 22 of the moldboard, the snow shield 23, and the cutting edge, in other embodiments, the snow shield 23 may be omitted from the trip edge. In some embodiments, the snow shield 23 may be omitted from the V-blade altogether. In other embodiments, the snow shield may be fixedly engaged with central hinge 14 or on a central shaft. The snow shield may then remain in a fixed orientation relative to the central hinge 14 or the central shaft at all times.

It will be understood that if cutting edge 24, base plate 44, and/or snow shield 23 become damaged or worn down over time, the operator may simply remove the fasteners 46 and/or 50, disengage the damaged cutting edge 24, base plate 44, and/or snow shield 23 from the lower section 22 and install a new/replacement component. The new/replacement component will be secured to the lower section 22 by reengaging the fasteners 46 and/or 50.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A V-blade for a snowplow comprising:
- a left wing;
- a right wing; and
- a trip edge provided on each of the left wing and the right wing;
- wherein each trip edge has a first degree of freedom and a second degree of freedom;
- wherein each trip edge is adapted to be tripped during use by encountering an obstacle on a surface being cleared of snow by the V-blade;
- wherein the trip edge undergoes a first motion and a subsequent second motion when the trip edge is tripped, and the second motion is different from the first motion; and
- wherein the first motion is rotational motion about a horizontal axis and the subsequent second motion is linear motion along the horizontal axis.

2. The V-blade according to claim 1, wherein each of the left wing and the right wing includes a moldboard with which the trip edge is operatively engaged; and wherein the trip edge is biased into a non-tripped position relative to the moldboard.

3. The V-blade according to claim 2, further comprising a spring assembly that biases the trip edge into the non-tripped position.

4. The V-blade according to claim 1, wherein the V-blade is a multi-position blade and the left wing and right wing are operably engaged with a central hinge.

5. The V-blade according to claim 1, wherein each of the left wing and the right wing includes a moldboard having an upper section and a lower section; and wherein the lower section is separate from the upper section and comprises a first part of the trip edge.

6. The V-blade according to claim 5, wherein each of the left wing and the right wing further comprises a cutting edge that is removably engaged with the lower section of the moldboard; and the cutting edge comprises a second part of the trip edge.

7. The V-blade according to claim 6, wherein each of the left wing and the right wing further comprises a snow shield that is at least partially aligned with a central shaft that is interposed between the left wing and the right wing; and wherein the snow shield comprises a third part of the trip edge.

8. The V-blade according to claim 7, wherein the snow shield angles rearwardly from the lower section and inwardly toward a vertical axis extending along the central shaft.

9. The V-blade according to claim 1, wherein the trip edge moves first through the first motion and then through the second motion when tripped during use of the V-blade.

10. A V-blade for a snowplow comprising:
- a left wing;
- a right wing; and
- a trip edge provided on each of the left wing and the right wing;
- wherein each trip edge has a first degree of freedom and a second degree of freedom;
- wherein the first degree of freedom is rotational motion about a horizontal axis and the second degree of freedom is linear motion along the horizontal axis;
- wherein each trip edge is adapted to be tripped by encountering an obstacle on a surface being cleared of snow by the V-blade; and
- a cam provided on the trip edge, wherein the cam transforms the rotational motion to the linear motion.

11. The V-blade according to claim 10, further comprising a snow shield provided on a first side of the trip edge; and wherein the snow shield acts as the cam.

12. In combination:
- a utility vehicle;
- a blade adapted to clear snow from a surface; and
- a hitch assembly that detachably engages the blade to the utility vehicle, wherein the hitch assembly is operable to manipulate the blade relative to the surface being cleared of snow;
- wherein the blade includes:
  - a moldboard and a trip edge provided on each of a left wing and a right wing of the blade, wherein each trip edge has a first degree of freedom and a second degree of freedom relative to the associated moldboard, wherein each trip edge is adapted to trip by encountering an obstacle on the surface being cleared of snow;
  - wherein the trip edge undergoes a first motion and a subsequent second motion when the trip edge is tripped, and the second motion is different from the first motion;
  - wherein the trip edge moves through the first motion and the second motion when the blade is in a V-configuration and the trip edge is tripped; and
  - wherein the first motion when the trip edge is tripped is rotation about a horizontal axis; and the second motion when the trip edge is tripped is linear motion along the horizontal axis.

13. The combination as defined in claim 12, wherein the blade is a multi-position blade.

14. A method of preventing damage to a V-blade of a snowplow comprising:

operatively engaging a left wing and a right wing of the V-blade with a central shaft;

providing a trip edge on a moldboard of each of the left wing and the right wing of the V-blade;

biasing the trip edge into alignment with the moldboard;

biasing the trip edge toward the central shaft;

pivoting the trip edge relative to the moldboard about a horizontal axis when the trip edge impacts an obstacle on a surface from which the V-blade is clearing snow; and translating the trip edge linearly in a first direction along the horizontal axis when the trip edge pivots.

15. The method according to claim 14, wherein the translating of the trip edge in the first direction includes moving the trip edge away from the central shaft when the trip edge on the left wing begins to contact the trip edge on the right wing.

16. The method according to claim 14, further comprising:

moving beyond the obstacle;

translating the trip edge linearly along the horizontal axis in an opposite second direction relative to the moldboard; and pivoting the trip edge about the horizontal axis and back into alignment with the moldboard.

17. The method according to claim 14, further comprising:

providing a cam along a first side of the trip edge and at least partially beneath the central shaft;

transforming a pivotal motion of the trip edge to a linear motion of the trip edge utilizing the cam.

* * * * *